US008841054B2

(12) United States Patent
Dojo et al.

(10) Patent No.: US 8,841,054 B2
(45) Date of Patent: Sep. 23, 2014

(54) IMAGE-FORMING METHOD, MAGNETIC TONER, AND PROCESS UNIT

(75) Inventors: Tadashi Dojo, Numazu (JP); Michihisa Magome, Mishima (JP); Eriko Yanase, Suntou-gun (JP); Takashi Matsui, Suntou-gun (JP); Tomohisa Sano, Suntou-gun (JP); Akira Sakakibara, Susono (JP); Shuichi Hiroko, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/254,393

(22) Filed: Oct. 20, 2008

(65) Prior Publication Data

US 2009/0047043 A1 Feb. 19, 2009

Related U.S. Application Data

(63) Continuation of application No. PCT/JP2008/060814, filed on Jun. 6, 2008.

(30) Foreign Application Priority Data

Jun. 8, 2007 (JP) ..... 2007-152221

(51) Int. Cl.
*G03G 15/08* (2006.01)
*G03G 9/083* (2006.01)
*G03G 9/08* (2006.01)

(52) U.S. Cl.
CPC ..... *G03G 9/083* (2013.01); *G03G 15/0813* (2013.01); *G03G 9/0827* (2013.01)
USPC ..... 430/106.1; 399/252

(58) Field of Classification Search
USPC ..... 399/252; 430/106.1
See application file for complete search history.

(56) References Cited

U.S. PATENT DOCUMENTS 5,978,634 A * 11/1999 Sato et al. ..... 399/277
6,593,051 B1 7/2003 Hirota et al.

(Continued)

FOREIGN PATENT DOCUMENTS

EP 0 581 257 A1 2/1994
EP 1 632 815 A2 3/2006

(Continued)

OTHER PUBLICATIONS

International Preliminary Report on Patentability, issued Dec. 23, 2009 in PCT/JP2008/060814, 11 pages.

(Continued)

*Primary Examiner* — Mark F Huff
*Assistant Examiner* — Rachel Zhang
(74) *Attorney, Agent, or Firm* — Fitzpatrick, Cella, Harper and Scinto

(57) ABSTRACT

An image-forming method is provided which can provide stable image density irrespective of use environments and does not cause image defects such as fogging, tailing, or transfer voids, even when being applied to a developing sleeve with a reduced diameter. In the image-forming method, a latent image bearing member and a toner bearing member bearing a magnetic toner on its surface and having inside a unit for generating a magnetic field are placed with a predetermined interval, and an alternating field is applied between the latent image bearing member and the toner bearing member, and an electrostatic latent image borne by the latent image bearing member is developed with the magnetic toner. The toner bearing member has a specific diameter, and the magnetic toner has a specific circularity and a specific compressibility. The total energy of the toner measured with a powder flowability measuring apparatus satisfies a specific value.

8 Claims, 2 Drawing Sheets

(56) References Cited

U.S. PATENT DOCUMENTS

| | | | | |
|---|---|---|---|---|
| 7,003,249 | B2 | 2/2006 | Hasegawa et al. | 399/254 |
| 7,330,683 | B2 | 2/2008 | Matsuzaki | 399/279 |
| 7,452,649 | B2 | 11/2008 | Magome et al. | 430/111.3 |
| 7,906,266 | B2 | 3/2011 | Magome et al. | |
| 2002/0012551 | A1 | 1/2002 | Tsutsui et al. | |
| 2004/0191659 | A1* | 9/2004 | Nakamura et al. | 430/108.8 |
| 2005/0048386 | A1 | 3/2005 | Kato et al. | |
| 2006/0188800 | A1* | 8/2006 | Magome et al. | 430/106.1 |
| 2007/0065742 | A1 | 3/2007 | Ishizuka et al. | |

FOREIGN PATENT DOCUMENTS

| | | | |
|---|---|---|---|
| JP | 6-110324 | A | 4/1994 |
| JP | 07-120968 | | 5/1995 |
| JP | 9-080913 | A | 3/1997 |
| JP | 2000-181128 | A | 6/2000 |
| JP | 2001-356516 | A | 12/2001 |
| JP | 2002-091142 | A | 3/2002 |
| JP | 2002-116576 | A | 4/2002 |
| JP | 2002-278129 | A | 9/2002 |
| JP | 2002-278146 | | 9/2002 |
| JP | 2003-043738 | A | 2/2003 |
| JP | 2004-163476 | | 6/2004 |
| JP | 2004-191546 | | 7/2004 |
| JP | 2004-212540 | | 7/2004 |
| JP | 2004-301867 | | 10/2004 |
| JP | 2005-049861 | A | 2/2005 |
| JP | 2005-091437 | A | 4/2005 |
| JP | 2005-331821 | | 12/2005 |
| JP | 2006-227377 | A | 8/2006 |
| JP | 2006-323326 | | 11/2006 |
| JP | 2007-079116 | A | 3/2007 |
| JP | 2007-079117 | | 3/2007 |
| JP | 2007-108675 | | 4/2007 |
| JP | 2007-139846 | | 6/2007 |

OTHER PUBLICATIONS

Official Action dated Mar. 29, 2011 in Korean Application No. 10-2009-7016249.

Official Action dated Apr. 20, 2011 in Chinese Application No. 200880003105.5.

European Search Report dated Apr. 17, 2012 in European Application No. 08765555.1.

* cited by examiner

IMAGE-FORMING METHOD, MAGNETIC TONER, AND PROCESS UNIT

This application is a continuation of International Application No. PCT/JP2008/060814, filed on Jun. 6, 2008, which claims the benefit of Japanese Patent Application No. 2007-152221 filed on Jun. 8, 2007.

BACKGROUND OF THE INVENTION

1. Field of the Invention

The present invention relates to an image-forming method to be used in a recording method employing an electrophotographic method, electrostatic recording method, electrostatic printing method, or toner jet system recording method.

2. Description of the Related Art

In recent years, an image-forming apparatus for an electrophotographic method, electrostatic recording method, or the like has been required to be more small-sized, lightweight, and high-speed. In order to achieve miniaturization, it is essential to reduce the diameter of a latent image bearing member, toner bearing member, or the like in an image-forming process. As the diameter of a photosensitive drum as a latent image bearing member or of a developing sleeve as a toner bearing member is reduced, the curvature of the drum or sleeve increases, so a developing zone becomes extremely narrow in a developing portion. As a result of the narrowing of the developing zone, some detrimental effects occur particularly in a jumping developing method as one dry developing method involving the use of a magnetic one-component toner (Japanese Patent Application Laid-Open No. H06-110324).

One detrimental effect due to the narrowing of the developing zone is a reduction in image density due to insufficient supply of toner. When various developing conditions such as a reduction in magnetic force of a magnet included in a developing sleeve are changed for alleviating such a reduction in density, even toner which is not sufficiently charged flies, with the result that fogging or toner scattering increases. In addition, density unevenness in association with the period of the developing sleeve (the so-called sleeve ghost) or the like is liable to occur.

In addition, some phenomena occurring in the jumping developing method owing to the narrowing of the developing zone come to be promoted. For example, an edge effect occurs in which development is carried out with magnetic toner concentrated at the edge portion of a latent image, so a transfer void occurring when a toner image formed on a photosensitive member is brought into press contact with a transfer material in the case of, for example, a contact transfer method, is liable to occur. In addition, an image is developed with magnetic toner in the form of a chain (referred to as "ear") at the time of the development, so a phenomenon referred to as tailing is also liable to occur in which the magnetic toner protrudes from an image portion while being in an ear state.

Further, the magnetic toner is apt to receive a large stress because the number of revolutions of the developing sleeve increases in association with a reduction in diameter of the sleeve. As a result, a problem known as the so-called toner deterioration is also liable to occur: for example, a treatment agent afterward added externally to toner particles is embedded in, or eliminated from, the toner particles, or toner particle are chipped. As such deterioration proceeds, when the toner is repeatedly used, the charge quantity of the toner is lowered, or generated fine powder is stuck to the developing sleeve or a control member, with the result that an image defect in association with insufficient charging is liable to occur.

The following attempt has been made to alleviate such problems: the flowability of magnetic toner is controlled. For example, the cohesion degree of toner is adjusted (Japanese Patent Application Laid-Open No. 2003-043738), or the compressibility of toner is controlled (Japanese Patent Application Laid-Open No. 2000-181128 or Japanese Patent Application Laid-Open No. 2001-356516). However, such attempts still involve problems associated with an improvement in image quality and an improvement in durability of toner when the toner is combined with a developing sleeve with a reduced diameter.

SUMMARY OF THE INVENTION

An object of the present invention is to provide an image-forming method, a magnetic toner, and a process unit, which are capable of solving such problems as described above.

That is, the object of the present invention is to provide an image-forming method, a magnetic toner, and a process unit which can provide stable image density in spite of use environments and do not cause image defects such as fogging, tailing and a transfer void, even when being applied to a developing sleeve with a reduced diameter.

Another object of the present invention is to provide a miniaturized process unit.

The inventors of the present invention have found that in a toner applied to a toner bearing member having a diameter of 5.0 mm or more and less than 12.0 mm, the compressibility of a magnetic toner and the total energy of the toner measured with a powder flowability measuring apparatus are optimized so that the toner can achieve a stable image density and an improvement in image quality, and at the same time, the unit can be reduced in size, and have completed the present invention.

That is, the present invention is as follows:

An image-forming method including applying an alternating field between a latent image bearing member and a toner bearing member bearing on its surface a magnetic toner and having inside a unit for generating a magnetic field, the latent image bearing member and the toner bearing member being placed with a predetermined interval therebetween, to develop an electrostatic latent image formed on the latent image bearing member with the magnetic toner, wherein the toner bearing member has an outer diameter of 5.0 mm or more and less than 12.0 mm, the magnetic toner includes magnetic toner particles containing at least a binder resin and a magnetic powder, and an inorganic fine powder, the magnetic toner has an average circularity of 0.950 or more and a compressibility of 30 or less obtained from the following expression (1):

$$\text{Compressibility}=\{1-(\text{apparent density}/\text{tap density})\}\times 100 \quad (1);$$

and the total energy of the toner measured with a powder flowability measuring apparatus satisfies the following expressions (2) and (3):

$$600 \leq TE_{10} \leq 1{,}500 \quad (2)$$

$$TE_{10}/TE_{100} \leq 1.60 \quad (3)$$

where $TE_{10}$ represents total energy (mJ) when a stirring rate is 10 mm/sec, and $TE_{100}$ represents total energy (mJ) when a stirring rate is 100 mm/sec.

According to the present invention, an image-forming method, a magnetic toner and a process unit can be provided which can achieve miniaturization, and provide high quality images free of fogging, tailing or a transfer void regardless of use environments.

Further features of the present invention will become apparent from the following description of exemplary embodiments with reference to the attached drawings.

DESCRIPTION OF THE EMBODIMENTS

Figure 1:
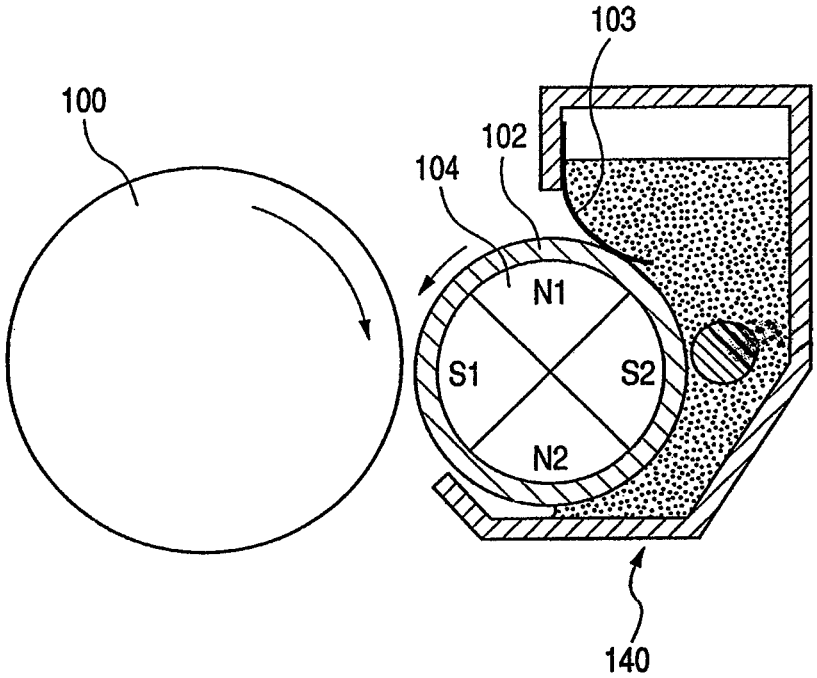
FIG. 1 is an explanatory view of a process unit to which a magnetic toner of the present invention is applicable.

Hereinafter, the present invention will be described in detail.

A reduction in diameter of a toner bearing member (such as a developing sleeve) in association with, for example, a reduction in size of a process unit is advantageous for the stabilization of the laid-on level and charge quantity of toner on the toner bearing member because the number of times at which the toner bearing member is contacted with a control member increases. In such a case, however, a state in which magnetic toner flies in a narrow developing zone largely influences the image quality. A state in which the magnetic toner flies to a photosensitive drum is largely affected by formation of the "ears" of the toner on the toner bearing member and ease with which the "ears" of the toner collapse in the developing zone.

The inventors of the present invention have made extensive studies. As a result, the inventors have found that the formation of the "ears" of the magnetic toner on the toner bearing member and the state in which the toner flies in the developing zone are closely correlated with the compressibility of the magnetic toner and the total energy of the toner measured with a powder flowability measuring apparatus. Thus, the inventors have arrived at the present invention.

First, in the present invention, the compressibility of the magnetic toner is defined by the following expression (1).

$$\text{Compressibility}=\{1-(\text{apparent density}/\text{tap density})\}\times 100 \quad (1)$$

The compressibility is a value calculated from the apparent density and tap density of the toner, and represents the rate of change between the apparent density and the tap density. A state in which the magnetic toner is stirred in the vicinity of the toner bearing member or a state in which the toner is pressed against the toner bearing member fluctuates in response to, for example, a change of environment and the remaining amount of the toner over time. In particular, when the diameter of the toner bearing member is reduced, the formation of the "ears" tends to become unstable in relation to such fluctuation because chances for the toner bearing member to come in contact with the magnetic toner decreases owing to a reduction in surface area of the toner bearing member. The compressibility of the magnetic toner serves as an indicator showing the stability of the formation of the "ears" of the toner in relation to such fluctuation.

In the present invention, the compressibility of the magnetic toner should be set to 30 or less. When the compressibility becomes larger than 30, the state in which the toner is pressed in the vicinity of the toner bearing member is largely changed in the case where the diameter of the toner bearing member is reduced. As a result, the formation of the "ears" of the toner on the toner bearing member is liable to become unstable. To be specific, when the length of each of the ears on the toner bearing member becomes long or the density of the ears becomes excessively high, the "ears" of the toner is difficult to collapse in the developing zone, and an image defect such as a transfer void or tailing is liable to occur.

Further, in the present invention, the total energy of the magnetic toner measured with a powder flowability measuring apparatus is required to satisfy the following expressions (2) and (3). It should be noted that the term "total energy" refers to the sum of force needed to push a stirring blade into a powder of the toner and force needed to rotate the stirring blade in the powder.

$$600 \leq TE_{10} \leq 1{,}500 \quad (2)$$

$$TE_{10}/TE_{100} \leq 1.60 \quad (3)$$

where $TE_{10}$ represents total energy (mJ) when a stirring rate is 10 mm/sec, and $TE_{100}$ represents total energy (mJ) when a stirring speed is 100 mm/sec.

In the measurement, the total energy of the magnetic toner when the stirring rate is changed can be measured unlike the conventional measurement of the cohesion degree of the toner. As a result of the investigation conducted by the inventors of the present invention, it has been found that the "value and rate of change of the total energy" and the "state in which the toner flies between the toner bearing member and the latent image bearing member" are correlated with each other.

When changing the stirring rate, it is possible to estimate how the cohesive force between toner particles is changed in relation to a change in flow rate of the toner powder. That the total energy is low and the rate of change is small in relation to the fluctuation of the flow rate means that the cohesive force between toner particles is stabilized at a low level. In particular, the cohesive force between the particles of the toner should be made as low as possible in order that the toner is caused to stably fly between a developing sleeve with a reduced diameter and a photosensitive drum in a narrow developing zone in the developing sleeve in a state in which the "ears" of the toner are collapsed. In addition, measurement with a powder flowability measuring apparatus is effective in estimating the cohesive force between toner particles.

In the present invention, $TE_{10}$ is 600 mJ or more and 1,500 mJ or less. $TE_{10}$ should not exceed 1,500 mJ because the cohesive force between the particles of the toner becomes so high that the collapse of the "ears" of the toner does not proceed, and the image density or image quality tends to be reduced in association with the narrowing of the developing zone itself. In addition, when $TE_{10}$ is set to 600 mJ or more, suitable stress can be applied to the toner, so the toner can be charged quickly and sharply even when the toner is applied to a toner bearing member with a reduced diameter.

In addition, $TE_{10}/TE_{100}$ is 1.60 or less. When the value of the ratio exceeds 1.60, a state in which the toner flies is more apt to change when such a state of the "ears" of the toner on the toner bearing member as described above changes. As a result, deterioration in image quality (such as a transfer void, fogging, or tailing) is apt to occur in association with a change of use environment and change over time.

As examples of the method of controlling the compressibility of the toner and the total energy of the toner measured with a powder flowability measuring apparatus, the following methods (A) to (D) may be cited. The control may be achieved by any one of those methods alone or by a combination of two or more of them.

(A) A method involving optimizing the grain size distribution of the magnetic toner and optimizing the amounts of the fine and coarse powders of the toner to control the packing performance of the toner.

(B) A method involving improving the shape (average circularity) and surface smoothness of the magnetic toner to reduce the contact area between toner particles.

(C) A method involving adhering two or more types of layers formed from organic and/or inorganic fine particles whose surface energy, hydrophobicity, particle diameter and the like are optimized to the magnetic toner surfaces.

(D) A method involving optimizing the magnetic properties of the magnetic toner to reduce the magnetic cohesiveness of the toner.

In the present invention, the toner has an average circularity of 0.950 or more, preferably 0.960 or more. One possible reason for this is as follows: when the average circularity of the magnetic toner is high, the "ears" of the toner on a developing sleeve easily become short, and furthermore, the cohesive force between the particles of the toner reduces, so the collapse of the "ears" in a developing zone easily proceeds. In addition, an image having a high density and high quality can be obtained as long as the average circularity falls within the above range.

In addition, the toner of the present invention has a weight average particle diameter (D4) of preferably 4.0 μm or more and 9.0 μm or less. When the weight average particle diameter (D4) of the toner exceeds 9.0 μm, the reproducibility of a fine dot image deteriorates. On the other hand, when the weight average particle diameter (D4) of the toner is smaller than 4.0 μm, the specific surface area of the toner increases, and hence the cohesive force between the toner particles becomes so high that a problem such as low image density or an image defect is liable to occur. In the present invention, the effect of improving the charging stability or flowability of the toner appears more significantly when the weight average particle diameter is 4.0 μm or more and 9.0 μm or less, and more preferably 5.0 μm or more and 8.0 μm or less in terms of an additional improvement in image quality.

In the present invention, the effect can be more easily obtained by controlling the magnetic properties of the magnetic toner. The residual magnetization of the toner when the toner is magnetized in a magnetic field of 79.6 kA/m is preferably set to 3.0 $Am^2/kg$ or less because the magnetic cohesiveness of the toner can be reduced, and the state in which the toner flies in a developing zone easily becomes such that the "ears" of the toner are additionally collapsed.

Next, the constitution of the present invention will be described with reference to FIG. 1.

In FIG. 1, the process unit includes a photosensitive drum 100 as a latent image bearing member, a developing sleeve 102 as a toner bearing member, a magnet roller 104 as a unit for generating a magnetic field, a developer container 140 serving also as a toner container for storing magnetic toner, and a developing blade 103 as a toner control member.

The photosensitive drum 100 rotates in the direction indicated by an arrow shown in FIG. 1, and an electrostatic latent image is formed on the surface of the drum by an unshown charging unit and an unshown unit for forming and exposing a latent image.

The magnet roller 104 is placed in the developing sleeve 102. Multiple magnetic poles are placed in the magnet roller 104, and the magnetic toner in the developer container 140 is laid on the surface of the developing sleeve 102 by the magnetic force of the roller. The developing sleeve 102 rotates in the direction indicated by an arrow shown in FIG. 1, and the magnetic toner is controlled by the developing blade 103 in contact with the surface of the sleeve, whereby a toner layer with a uniform laid-on level is obtained.

The generating line of the photosensitive drum 100 and the axis line of the developing sleeve 102 are placed so as to be substantially parallel to each other, and the photosensitive drum 100 and the developing sleeve 102 are close and opposite to each other with a predetermined interval between them. One of the magnetic poles of the magnet roller 104 is placed so as to be substantially in line with the position where the photosensitive drum 100 and the developing sleeve 102 are closest to each other. The surface moving speeds (circumferential speeds) of the photosensitive drum 100 and the developing sleeve 102 are substantially identical to each other, or the circumferential speed of the developing sleeve 102 is slightly higher than that of the photosensitive drum 100. An alternating field is applied between the photosensitive drum 100 and the developing sleeve 102. That is, a DC voltage and an AC voltage are applied in a superimposed fashion by an alternating bias voltage applying unit and a DC bias voltage applying unit.

In the present invention, the developing sleeve (toner bearing member) has a diameter of preferably 5.0 mm or more and less than 12.0 mm. When the diameter is 12.0 mm or more, sufficient miniaturization cannot be realized, and a reduction in size of a process unit cannot be achieved. In addition, when the diameter is less than 5.0 mm, the rigidity of the developing sleeve itself is lowered, so an image defect such as pitch unevenness due to the deflection or the like of the sleeve is liable to occur, and at the same time, chances for the magnetic toner to come in contact with the developing sleeve are extremely reduced, so it becomes difficult to provide the toner with suitable charge quantity. It should be noted that, in the present invention, the developing sleeve has a diameter of more preferably 6.0 mm or more and 10.0 mm or less.

In addition, the magnetic flux density of the unit for generating a magnetic field included in the toner bearing member toward the latent image bearing member is preferably 600 G or more and 800 G or less at the surface of the toner bearing member. When the magnetic flux density falls within the above range, appropriate magnetic binding force is obtained, so the movement of the toner between the latent image bearing member and the toner bearing member is favorably performed, and a particularly good image can be formed.

Next, the constitution of the toner bearing member to be used in the present invention will be described. The toner bearing member to be used in the present invention preferably has at least a base body and a resin coat layer formed on the surface of the base body.

A cylindrical member, a columnar member, a belt-like member or the like can be used as the base body. A cylindrical tube or solid rod made of a rigid body such as a metal is preferably used as the base body in a developing method in which the toner is in non-contact with the photosensitive drum. Such a base body can be prepared by: molding a non-magnetic metal or alloy such as aluminum, stainless steel, or brass into a cylindrical shape or columnar shape; and subjecting the molded product to abrasion, grinding, or the like. The base body is molded or processed with high accuracy in order that the uniformity of an image may be improved. For example, the base body has a straightness in its longitudinal direction of preferably 30 μm or less, more preferably 20 μm or less, or still more preferably 10 μm or less. A fluctuation in gap between the toner bearing member and the latent image bearing member, for example, a fluctuation in gap between the toner bearing member and a plane perpendicular to the toner bearing member when the toner bearing member is rotated while being brought into contact with the perpendicular plane through a uniform spacer is preferably 30 μm or less, more preferably 20 μm or less, or still more preferably 10 μm or less. Aluminum is preferably used in the base body because the material is available at a low cost, and can be easily processed.

The surface of the base body may be subjected to blasting in order that the property with which the toner is transported may be improved. To be specific, a blast material such as spherical glass beads (not limited thereto) is sprayed from a blast nozzle on the surface of the base body under a predetermined pressure for a predetermined time period so that the surface of the base body is subjected to blasting, and a large number of dents are formed on the surface of the base body.

Next, the resin coat layer will be described in detail.

A generally known resin can be used as a binder resin component in the resin coat layer of the toner bearing member of the present invention. Examples of the usable resin include: thermoplastic resins such as a polyester resin, a fluorine resin, a polyimide resin, a polyamide resin, an acrylic resin, a styrene-type resin, a vinyl-type resin, a polyether sulfone resin, a polycarbonate resin, a polyphenylene oxide resin, and a cellulosic resin; and heat- or photo-curable resins such as a phenol resin, a polyurethane resin, a polyester resin, a polyimide resin, a silicone resin, a melamine resin, a guanamine resin, a urea resin, an epoxy resin, and an alkyd resin. Of those, a resin having release properties such as a silicone resin, or a resin excellent in resistance to a mechanical or physical load such as a phenol resin, a polyurethane resin, a melamine resin, a guanamine resin, a urea resin, a fluorine resin, a polyimide resin, a polyester resin, an acrylic resin, or a styrene resin is preferable. When the resin coat layer of the above toner bearing member contains any one of these resins as a binder resin component, the toner bearing member can provide the toner with suitable triboelectric charge. As a result, problems such as a reduction in image density and the unevenness of image density can be favorably suppressed.

Further, the durability of the toner bearing member can be additionally improved when the resin coat layer contains multiple resins as binder resin components, and one of the resins is a phenol resin. As a result, a developing method can be provided in which, even in continuous copying, the toner on the toner bearing member is provided with uniform charge, and hence high-quality images free of a reduction in image density, density unevenness and fogging can be obtained during extensive operation.

In addition, in the present invention, the resin coat layer preferably has conductivity. When an image is formed with a toner having a small particle diameter or a toner having a high sphericity, nonuniform charging or charge-up of the toner at an initial stage is apt to occur, but such charging or charge-up can be favorably suppressed by providing the toner bearing member with a conductive resin coat layer. Further, the toner can be stably provided with triboelectric charge irrespective of use environment, and the charge-up of the toner does not occur even when the triboelectricity of the toner is raised owing to an increase in the number of sheets on which images are formed, so images having stably high quality from beginning to end can be obtained.

The resin coat layer has a volume resistivity of preferably $10^{-1}$ Ω·cm or more and $10^{4}$ Ω·cm or less, or more preferably $10^{-1}$ Ω·cm or more and $10^{3}$ Ω·cm or less. When setting the volume resistivity of the resin coat layer to $10^{4}$ Ω·cm or less, the toner can be stably provided with charge.

A conductive substance that can be used for adjusting the volume resistivity of the resin coat layer is, for example, a metal powder such as aluminum, copper, nickel or silver, a metal oxide powder such as antimony oxide, indium oxide or tin oxide, or a carbon substance such as carbon fibers, carbon black, graphitized carbon black or graphite. Of those, carbon black, in particular, conductive amorphous carbon is suitably used because the material is particularly excellent in electrical conductivity so that by merely controlling of the amount of the material to be added, the resin coat layer can be provided with arbitrary conductivity to some extent. In addition, the material can be added after its conductivity is adjusted by being applied to a polymer material.

In addition, graphitized carbon black that can be used in the present invention has a primary particle diameter of preferably 10 nm or more and 100 nm or less, or more preferably 10 nm or more and 70 nm or less. When setting the primary particle diameter to 10 nm or more, cohesiveness between graphitized carbon black particles is lowered, and hence the viscosity of a coating liquid prepared by dispersing graphitized carbon black together with, for example, the binder resin component can be inhibited from increasing. As a result, the dispersibility of graphitized carbon black in the coating liquid is improved, and the liquid can easily be made uniform. When setting the primary particle diameter to 100 nm or less, graphitized carbon black is present in the resin coat layer at high density, and the surface of the resin coat layer is made excellent and uniform in conductivity. As a result, the leak of the charge of the toner hardly occurs even when a developing bias is applied to the toner.

Such conductive substance, which is suitable in the present invention, is added in an amount in the range of preferably 1 part by mass to 100 parts by mass with respect to 100 parts by mass of the binder resin component in the resin coat layer.

In addition, an additionally preferable result can be obtained by adding solid particles for forming irregularities (which is referred to also as "irregularity-providing particles") to the inside of the resin coat layer in order to make the surface roughness uniform and to maintain suitable surface roughness.

The irregularity-providing particles that can be used in the present invention are preferably spherical. When the spherical irregularity-providing particles are used, the resin coat layer can obtain desired surface roughness and, at the same time, a surface with irregularities in a uniform surface shape while the amount of the particles to be added is reduced as compared with the case where amorphous irregularity-providing particles are used. Further, even when the surface of the resin coat layer has worn, a change of the surface roughness of the resin coat layer is small, and a change in thickness of a toner layer on the toner bearing member is difficult to bring about, so that the charging of the toner can be uniformized, and a streak or uneven images are less apt to occur.

The spherical irregularity-providing particles to be used in the present invention have a volume average particle diameter of preferably 0.3 μm or more and 30 μm or less, or more preferably 2 μm or more and 20 μm or less. When setting the volume average particle diameter of the spherical irregularity-providing particles to 0.3 μm or more, the surface of the resin coat layer can be provided with uniform surface roughness, and the charge-up of the toner due to the wear of the resin coat layer can be inhibited, and the contamination of the toner bearing member with the toner and the melt adhesion of the toner to the toner bearing member can be inhibited. In addition, the deterioration of an image or a reduction in image density due to a sleeve ghost does not occur. On the other hand, when setting the volume average particle diameter of the spherical irregularity-providing particles to 30 μm or less, the surface roughness of the resin coat layer falls within a suitable range, the amount of the toner to be transported and a toner coating on the toner bearing member are made uniform, and the toner can be uniformly charged. In addition, no protrusions of coarse particles occur, and the occurrence of a white or black spot due to an image streak or bias leak can be prevented. Further, no reduction in mechanical strength of the resin coat layer occurs.

In the present invention, conventionally known spherical irregularity-providing particles can be suitably used as long as the particles have a volume average particle diameter of 0.3 μm or more and 30 μm or less. Examples of the irregularity-providing particles that can be suitably used in the present invention include spherical resin particles, spherical metal oxide particles, and spherical carbonized substance particles. Of those, the spherical resin particles are preferable because the resin coat layer can be more easily provided with suitable surface roughness and a uniform surface shape in a smaller amount. The spherical resin particles that can be used in the present invention are easily obtained by, for example, a suspension polymerization method or a dispersion polymerization method. Of course, resin particles obtained by a pulverization method may be subjected to thermal or physical treatment and made spherical before being used.

Alternatively, inorganic fine powder may be adhered to, fixed to, or dispersed in, the surfaces of the spherical irregularity-providing particles to be used in the present invention with the aim of improving the dispersibility of the particles in the resin coat layer, the uniformity of the surface of the resin coat layer to be formed, the resistance of the resin coat layer to contamination, charge-providing performance to the toner, the wear resistance of the resin coat layer, or the like.

Examples of the usable inorganic fine powder include: oxides such as $SiO_2$, $SrTiO_3$, $CeO_2$, CrO, $Al_2O_3$, ZnO, and MgO; nitrides such as $Si_3N_4$; carbides such as SiC; and sulfates and carbonates such as $CaSO_4$, $BaSO_4$, and $CaCO_3$. Each of those inorganic fine powders is preferably treated with a coupling agent before being used. That is, an inorganic fine powder treated with a coupling agent can be particularly preferably used for the purpose of, for example, improving adhesiveness to the binder resin component in the resin coat layer or imparting hydrophobicity to the irregularity-providing particles.

In addition, a solid lubricant is preferably dispersed in the resin coat layer constituting the toner bearing member of the present invention together with the spherical irregularity-providing particles each having conductivity because the effect of the present invention is enhanced. Examples of the solid lubricant include crystalline graphite, molybdenum disulfide, boron nitride, mica, graphite fluoride, a silver-niobium selenide alloy, a calcium chloride-graphite alloy, talc, and a substance formed of an aliphatic acid metal salt such as zinc stearate. Of those, crystalline graphite is particularly preferably used because the conductivity of the conductive resin coat layer is not impaired when crystalline graphite is used in combination with the spherical irregularity-providing particles having conductivity.

The solid lubricant to be used has a volume average particle diameter of preferably 0.2 μm or more and 20 μm or less, or more preferably 1 μm or more and 15 μm or less. When setting the volume average particle diameter of the solid lubricant to 0.2 μm or more, sufficient lubricity can be obtained. When setting the volume average particle diameter to 20 μm or less, an influence of the solid lubricant on the surface roughness of the resin coat layer is reduced, the resin coat layer is difficult to abrade during extensive operation and the surface roughness is difficult to change, the surface of the resin coat layer comes to be stable, and the toner coating on the toner bearing member and the charging of the toner are stabilized.

In the present invention, a charge control agent may be incorporated into the above resin coat layer to adjust the charging performance of the toner bearing member.

Examples of the charge control agent include: nigrosin and products thereof modified with fatty acid metal salts; quaternary ammonium salts such as tributylbenzyl ammonium-1-hydroxy-4-naphthosulfonate and tetrabutyl ammonium tetrafluoroborate, and analogs thereof which are onium salts such as phosphonium salts or lake pigments (agents for making lake include phosphotungstic acid, phosphomolybdic acid, phosphotungsten molybdic acid, tannic acid, lauric acid, gallic acid, ferricyanide acid, and ferrocyanide); metal salts of higher fatty acids; diorganotin oxides such as butyltin oxide, dioctyltin oxide, and dicyclohexyltin oxide; diorganotin borates such as dibutyltin borate, dioctyltin borate, and dicyclohexyltin borate; guanidines; and imidazole compounds.

Next, a method of producing the toner in the present invention will be described.

The toner of the present invention can be produced by any one of known methods. Of those, a polymerization method for producing the toner in a wet medium such as a dispersion polymerization method, an association cohesion method, or a suspension polymerization method is preferable because the shape and surface property of the toner can be easily controlled, and the physical properties of the toner in the present invention can be easily obtained. Of those, the suspension polymerization method is particularly preferable.

The production of the toner by the suspension polymerization method as one exemplary production method will be described below. In the suspension polymerization method, the following is added in a polymerizable monomer: components required for the toner such as a magnetic powder (magnetic iron oxide), a coloring agent, a release agent, a plasticizer, a binder, a charge control agent, and a crosslinking agent, and other additives such as an organic solvent and dispersant that are added in order to decrease the viscosity of a polymer produced by a polymerization reaction. The mixture is uniformly dissolved or dispersed by a dispersing device such as a homogenizer, a ball mill, a colloid mill, or an ultrasonic dispersing device to prepare a polymerizable monomer system. The monomer system (monomer composition) thus obtained is suspended into an aqueous medium containing a dispersion stabilizer. In this case, it is recommendable that a high-speed dispersing device such as a high-speed agitator or an ultrasonic dispersing device is used to provide a desired toner particle size at once because the size distribution of the resultant toner particles becomes sharp. A polymerization initiator may be added simultaneously with the addition of other additives to the polymerizable monomer, or may be mixed immediately before suspension into an aqueous medium. In addition, immediately after granulation, a polymerization initiator dissolved in the polymerizable monomer or the solvent can be added before the initiation of a polymerization reaction.

After granulation, stirring has only to be performed by an ordinary agitator to the extent that the particle state is maintained and particles are prevented from floating and sedimenting.

In the suspension polymerization method, a known surfactant, or a known organic or inorganic dispersant may be used as a dispersion stabilizer. Of these, an inorganic dispersant can be preferably used for the reason described below: it is difficult for the inorganic dispersant to produce harmful ultrafine powder; the stability of the inorganic dispersant is difficult to collapse even when reaction temperature is changed because the dispersant has dispersion stability owing to steric hindrance; and the inorganic dispersant can be easily washed, and has no bad influence on the toner. Examples of such inorganic dispersant include: polyvalent metal phosphates such as calcium phosphate, magnesium phosphate, aluminum phosphate, and zinc phosphate; carbonates such as calcium carbonate and magnesium carbonate; inorganic salts such as calcium metasilicate, calcium sulfate, and barium sulfate; and inorganic oxides such as calcium hydroxide, magnesium hydroxide, aluminum hydroxide, silica, bentonite, and alumina.

When these inorganic dispersants are used, they may be used as they are, but, in order to obtain particles having a finer particle size, particles of the inorganic dispersants can be produced in the aqueous medium. For example, in the case of calcium phosphate, an aqueous solution of sodium phosphate and an aqueous solution of calcium chloride are mixed under high-speed stirring to produce water-insoluble calcium phosphate, and more uniform and finer dispersion can be performed. In this case, a water-soluble sodium chloride salt is simultaneously produced as a by-product. The presence of a water-soluble salt in the aqueous medium is more favorable because the water-soluble salt suppresses the dissolution of the polymerizable monomer into water, so ultra-fine toner due to emulsion polymerization is less apt to produce. The aqueous medium is preferably exchanged or desalted by an ion-exchange resin because the sodium chloride salt becomes an obstacle upon removal of a remaining polymerizable monomer at the terminal stage of polymerization reaction. The inorganic dispersants can be nearly completely removed by being dissolved in an acid or an alkali after the completion of polymerization.

Each of these inorganic dispersants is preferably used singly or in a combination of two or more types in an amount of 0.2 part by mass or more and 20 parts by mass or less with respect to 100 parts by mass of the polymerizable monomer.

In order to obtain finely granulated toner, the inorganic dispersants may be used in combination with 0.001 part by mass or more and 0.1 part by mass or less of a surfactant. Examples of the surfactant include sodium dodecylbenzene sulfate, sodium tetradecyl sulfate, sodium pentadecyl sulfate, sodium octyl sulfate, sodium oleate, sodium laurate, sodium stearate, and potassium stearate.

In the polymerization process, polymerization is preferably performed at a polymerization temperature of 40° C. or higher, or generally 50 or higher and 90° C. or lower. When the polymerization is performed at a temperature within the range, a release agent that must be sealed inside deposites owing to phase separation, thereby contributing to complete inclusion. The reaction temperature may be raised up to 90° C. or higher and 150° C. or lower at the terminal stage of the polymerization reaction in order to consume the remaining polymerizable monomer.

In the present invention, vapor is preferably introduced into a polymer dispersion liquid containing the resultant toner particles so as to control and adjust the shape and surface smoothness of the magnetic toner. For example, saturated vapor at a temperature of 100° C. or higher is introduced into the aqueous medium in the container in the latter half, or after the completion, of the polymerization.

Examples of the polymerizable monomer constituting the polymerizable monomer system to be used in the present invention include the following monomers: a styrene-type monomer such as styrene, o-methylstyrene, m-methylstyrene, p-methylstyrene, p-methoxystyrene, and p-ethylstyrene; acrylates such as methyl acrylate, ethyl acrylate, n-butyl acrylate, isobutyl acrylate, n-propyl acrylate, n-octyl acrylate, dodecyl acrylate, 2-ethylhexyl acrylate, stearyl acrylate, 2-chloroethyl acrylate, and phenyl acrylate; methacrylates such as methyl methacrylate, ethyl methacrylate, n-propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; acrylonitrile, methacrylonitrile, and acrylamide.

These polymerizable monomers can be used singly or in combination. Of those polymerizable monomers, the use of styrene or a styrene derivative alone or the use of styrene or a styrene derivative in combination with other polymerizable monomers is preferable in terms of the developing performance and the durability of the toner.

In the case where the toner of the present invention is produced by the polymerization method, when polymerization is carried out using a polymerization initiator with a half-life of 0.5 to 30 hours at a polymerization reaction in an amount of 0.5 to 20 mass % of the polymerizable monomers, a polymer is obtained having a maximum between 10,000 and 100,000 in the molecular weight distribution and providing the toner with desirable strength and solubility characteristics. Examples of the polymerization initiator include an azo-type or diazo-type polymerization initiator such as 2,2'-azobis-(2,4-dimethylvaleronitrile), 2,2'-azobisisobutylonitrile, 1,1'-azobis(cyclohexane-1-carbonitrile), 2,2'-azobis-4-methoxy-2,4-dimethylvaleronitrile, and azobisisobutylonitrile; a peroxide type-polymerization initiator such as benzoyl peroxide, methylethylketone peroxide, diisopropyl peroxycarbonate, cumene hydroperoxide, 2,4-dichlorobenzoyl peroxide, and lauroyl peroxide.

In the present invention, a crosslinking agent may be added. The amount of the agent to be added is preferably 0.001 to 15 mass % of the polymerizable monomer.

Basically, a crosslinking agent having two or more polymerizable double bonds is used herein. Examples of the crosslinking agent include an aromatic divinyl compound such as divinylbenzene and divinylnaphthalene; a carboxylic acid ester having two double bonds such as ethylene glycol diacrylate, ethylene glycol dimethacrylate, and 1,3-butanediol methacrylate; a divinyl compound such as divinyl aniline, divinyl ether, divinyl sulfide, and divinyl sulfone; and a compound having three or more vinyl groups. These can be used singly or in a mixture of two or more of them.

As the magnetic substance used in the toner of the present invention, conventionally known magnetic substances are used. Examples of the magnetic substance contained in the magnetic toner include: iron oxides such as magnetite, maghemite, and ferrite, and other iron oxides containing metal oxides; metals such as Fe, Co, and Ni, or alloys thereof with metals such as Al, Co, Pb, Mg, Ni, Sn, Zn, Sb, Be, Bi, Cd, Ca, Mn, Se, Ti, W, and V; and mixtures thereof.

Specifically, triiron tetraoxide ($Fe_3O_4$), iron sesquioxide ($\gamma$-$Fe_2O_3$), zinc iron oxide ($ZnFe_2O_4$), yttrium iron oxide ($Y_3Fe_5O_{12}$), cadmium iron oxide ($CdFe_2O_4$), gadolinium iron oxide ($Gd_3Fe_5O_{12}$), copper iron oxide ($CuFe_2O_4$), lead iron oxide ($PbFe_{12}O_{19}$), nickel iron oxide ($NiFe_2O_4$), neodymium iron oxide ($NdFe_2O_3$), barium iron oxide ($BaFe_{12}O_{19}$), magnesium iron oxide ($MgFe_2O_4$), manganese iron oxide ($MnFe_2O_4$), lanthanum iron oxide ($LaFeO_3$), iron powder (Fe), cobalt powder (Co), nickel powder (Ni), and the like can be exemplified. In the present invention, each of the magnetic substances contains at least a magnetic iron oxide, and one or two or more types of other metals can be arbitrarily selected and used with the magnetic substance as needed.

Particles of such magnetic iron oxide have a BET specific surface area by nitrogen adsorption of preferably 2 $m^2/g$ or more and 30 $m^2/g$ or less, particularly 3 $m^2/g$ or more and 28 $m^2/g$ or less, and have a Mohs hardness of preferably 5 or more and 7 or less.

Examples of the shape of the magnetic iron oxide include an octahedral shape, a hexahedral shape, a spherical shape, a needle shape, and a scaly shape. The magnetic iron oxide preferably has a shape with a low degree of anisotropy such as an octahedral shape, a hexahedral shape, a spherical shape or an amorphous shape in order to increase image density. Those shapes can be confirmed with SEM.

The grain size of the magnetic iron oxide is preferably such that, in grain size measurement intended for particles having a particle diameter of 0.03 μm or more, a number average particle diameter is 0.10 to 0.30 μm, and particles having a particle diameter of 0.03 to 0.10 μm account for 40 number % or less of all the measured particles.

In general, it is not preferable to form an image with a magnetic toner using a magnetic iron oxide having a number average particle diameter of less than 0.10 μm because the color of the image is shifted to reddish color so that, for example, the blackness of the image becomes insufficient, or there is an increased tendency for a halftone image to be sensed more strongly reddish. In addition, the dispersibility of the magnetic iron oxide deteriorates owing to an increase in the surface area of the magnetic iron oxide, with the result that the energy needed at the time of producing the toner increases, and the production is not efficient. In addition, an effect of the magnetic iron oxide as a colorant weakens, and the density of the image may be insufficient, so such magnetic iron oxide is not preferable.

On the other hand, when the number average particle diameter of the magnetic iron oxide exceeds 0.30 μm, the mass of the magnetic iron oxide per particle increases, so a probability that the magnetic iron oxide is exposed to the surface of the toner owing to an influence of a difference in specific gravity between the magnetic iron oxide and a binder at the time of producing the toner increases, a possibility that the wear or the like of an apparatus for producing the toner becomes remarkable increases, or the sedimentation stability or the like of a dispersed matter is lowered. Accordingly, such magnetic iron oxide is not preferable.

In addition, when particles having a particle diameter of 0.10 μm or less account for more than 40 number % of all the particles of the magnetic iron oxide in the toner, the surface area of the fine particles of the magnetic iron oxide increases to reduce the dispersibility of the magnetic iron oxide, so that the magnetic iron oxide is apt to produce agglomerates in the toner, and a possibility that the charging performance of the toner is impaired or the coloring power of the toner is lowered increases. Accordingly, the ratio is preferably 40 number % or less. The ratio is more preferably 30 number % or less because the foregoing tendency comes to be less.

In addition, in the present invention, particles having a particle diameter of 0.30 μm or more in the fine particles of the magnetic iron oxide preferably account for 10 number % or less of all the particles. The ratio in excess of 10 number % is not preferable for the reason that there is a tendency for the coloring power of the toner to decrease so that image density is reduced, and besides, even when the magnetic iron oxide is used in the same amount, the number of fine particles of the magnetic iron oxide becomes small, and hence, in light of a probability, it is difficult to cause magnetic iron oxide fine particles to be present in the vicinity of the surface of each toner particle and to cause the respective toner particles to contain the uniform number of magnetic iron oxide fine particles. The ratio is more preferably 5 number % or less.

The magnetic properties of such magnetic iron oxide when a magnetic field of 79.58 kA/m (1 kOe) is applied are preferably as follows: coercive force of 1.5 kA/m or more and 12 kA/m or less, saturation magnetization of 30 $Am^2/kg$ or more and 120 $Am^2/kg$ or less (more preferably 40 $Am^2/kg$ or more and 80 $Am^2/kg$ or less), and residual magnetization of 1 $Am^2/kg$ or more and 10 $Am^2/kg$ or less. It should be noted that the magnetic properties of a magnetic substance can be measured with an oscillation type magnetometer such as VSM P-1-10 (manufactured by TOEI INDUSTRY CO., LTD.) at 25° C. in an external magnetic field of 79.6 kA/m.

In the present invention, the magnetic properties and the amount of the magnetic substance to be added are preferably adjusted so that the residual magnetization of the magnetic toner magnetized in a magnetic field of 79.58 kA/m (1 kOe) is 3.0 $Am^2/kg$ or less.

When a polymerization method is applied in the toner according to the present invention, the magnetic iron oxide fine particles used as a magnetic substance have preferably been subjected to hydrophobic treatment. When adjusting the hydrophobic treatment, it is possible to control the presence state of the magnetic iron oxide in the toner strictly.

The following two methods are available for treating the surface of the magnetic iron oxide with a coupling agent or the like: dry treatment and wet treatment. The surface may be treated by any one of the methods in the present invention, but a wet treatment method in an aqueous medium is preferable because of the following reasons: it is difficult to cause the coalescence of the iron oxide particles as compared with a dry treatment in a vapor phase, and static repulsion acts between the magnetic iron oxide particles by virtue of hydrophobic treatment so that the surfaces of the magnetic iron oxide particles are treated with a coupling agent while being nearly in a primary particle state.

In the present invention, as a coupling agent that can be used for surface treatment of a magnetic iron oxide, a silane coupling agent and a titanium coupling agent are exemplified. Of those, the silane coupling agent is more preferably used, and includes substances represented by the general formula (A)

$$R_mSiY_n \quad (A)$$

(In the formula, R represents an alkoxy group, m represents an integer of 1 to 3, Y represents an alkyl group, a vinyl group, a methacryl group, a phenyl group, an amino group, an epoxy group, a mercapto group, or derivatives thereof, and n represents an integer of 1 to 3.) For example, the following may be cited vinyltrimethoxysilane, vinyltriethoxysilane, γ-methacryloxypropyltrimethoxysilane, vinyltriacetoxysilane, methyltrimethoxysilane, methyltriethoxysilane, isobutyltrimethoxysilane, dimethyldimethoxysilane, dimethyldiethoxysilane, trimethylmethoxysilane, hydroxypropyltrimethoxysilane, phenyltrimethoxysilane, n-hexadecyltrimethoxysilane, and n-octadecyltrimethoxysilane.

Particularly, it is preferable to subject the surfaces of magnetic iron oxides to hydrophobic treatment by using an alkyltrialkoxysilane coupling agent represented by the following formula (B)

$$C_pH_{2p+1}—Si—(OC_qH_{2q+1})_3 \quad (B)$$

(In the formula, p represents an integer of 2 to 20, and q represents an integer of 1 to 3.)

When p in the above formula is smaller than 2, the hydrophobic treatment is facilitated, but it may become difficult to impart sufficient hydrophobicity to the surfaces. In addition, when p is larger than 20, the surfaces obtain sufficient hydrophobicity, but the coalescence of the magnetic iron oxide particles increases, so it may become difficult to sufficiently disperse the magnetic iron oxide in the toner. In addition, when q is larger than 3, the reactivity of the silane coupling agent is reduced, so it may become difficult for the surfaces to be sufficiently made hydrophobic.

Accordingly, it is preferable to use an alkyltrialkoxysilane coupling agent represented by the formula where p represents an integer of 2 to 20 (more preferably an integer of 3 to 15) and q represents an integer of 1 to 3 (more preferably an integer of 1 or 2). The magnetic iron oxide fine particles are preferably treated with the agent in an amount of 0.05 to 20 parts by mass, or preferably 0.1 to 10 parts by mass with respect to 100 parts by mass of the magnetic iron oxide fine particles before the treatment.

A method of controlling the hydrophobicity of the magnetic iron oxide in the present invention is, for example, to treat the magnetic iron oxide with two or more types of silane coupling agents different from each other in p. When favorably adjusting the types of coupling agents and the amount of the coupling agents, the magnetic iron oxide with distribution corresponding to the hydrophobic treatment.

The surface treatment of the magnetic iron oxide with a coupling agent may be carried out by stirring appropriate amounts of the magnetic iron oxide and the coupling agent in the aqueous medium.

The term "aqueous medium" refers to a medium whose main component is water. Specific examples of the aqueous medium include: water itself; a medium obtained by adding a small amount of a surfactant to water; a medium obtained by adding a pH adjustor to water; and a medium obtained by adding an organic solvent to water. A nonionic surfactant such as polyvinyl alcohol is preferably used as the surfactant. The surfactant is preferably added at a content of 0.1 to 5 mass % to water. Examples of the pH adjustor include inorganic acids such as hydrochloric acid.

The stirring is sufficiently performed with, for example, a mixer having a stirring blade (specifically, a high-shear-force mixing apparatus such as an Attritor or a TK-homomixer) in such a manner that the iron oxide fine particles are turned into primary particles in the aqueous medium.

Since the magnetic iron oxide thus obtained has a surface uniformly subjected to a hydrophobic treatment, toner particles can be obtained in which the dispersibility of the magnetic iron oxide in a polymerizable monomer composition is extremely good, and the particles have a uniform magnetic iron oxide content.

The magnetic iron oxide to be used in the toner according to the present invention is produced by, for example, the following method.

An alkali such as sodium hydroxide is added to an aqueous solution of a ferrous salt such as an aqueous solution of ferrous sulfate in an amount equivalent to or more than the iron component of the solution, whereby an aqueous solution containing ferrous hydroxide is prepared. Air is blown into the prepared aqueous solution while the pH of the solution is maintained at 7 or more (preferably 8 to 10). Then, the oxidation reaction of ferrous hydroxide is performed while the aqueous solution is heated to 70° C. or higher. Thus, a seed crystal serving as the core of a magnetic iron oxide particle is produced first.

Next, an aqueous solution containing about 1 equivalent of ferrous sulfate based on the amount of the alkali previously added is added to a slurry-like liquid containing the seed crystal. Air is blown into the resultant liquid while the pH of the liquid is maintained at 6 to 10. During the blowing, the reaction of ferrous hydroxide is advanced so that magnetic iron oxide particles are grown with the seed crystal as a core. As the oxidation reaction proceeds, the pH of the liquid shifts to lower values. However, the pH of the liquid is not preferably less than 6. At the end of the oxidation reaction, the pH of the liquid is adjusted, and the liquid is sufficiently stirred so that the magnetic iron oxide is turned into primary particles. A coupling agent is added to the liquid, and is sufficiently mixed and stirred. After the stirring, the resultant is filtrated, dried, and lightly disintegrated, whereby a magnetic iron oxide subjected to hydrophobic treatment is obtained. Alternatively, the following procedure may be adopted: the magnetic iron oxide obtained by washing and filtration after the completion of the oxidation reaction is re-dispersed in another aqueous medium without being dried, the pH of the re-dispersion liquid is then adjusted, and coupling treatment is performed by adding a silane coupling agent to the re-dispersion liquid while sufficiently stirring the liquid.

In any case, an untreated magnetic iron oxide produced in the aqueous solution is preferably made hydrophobic while being in a water-containing slurry state which has not undergone the drying step. This is for the because when the untreated magnetic iron oxide is dried as it is, the coalescence of the magnetic iron oxide particles is inevitable, so it becomes difficult to make such powder in a cohesion states uniformly hydrophobic even by subjecting the powder to wet hydrophobic treatment.

Ferrous sulfate to be produced as a by-product in the production of titanium by a sulfuric acid method or ferrous sulfate to be produced as a by-product in association with the washing of the surface of a steel plate can be generally utilized as the ferrous salt to be used in the aqueous solution of the ferrous salt upon producing the magnetic iron oxide fine particles. Ferrous chloride or the like can also be used instead of ferrous sulfate.

In a method of producing a magnetic iron oxide by an aqueous solution method, an aqueous solution of ferrous-sulfate having an iron concentration of 0.5 to 2 mol/l is generally used in terms of the prevention of an increase in viscosity of the solution at the time of reaction between ferrous sulfate and an alkali, and the solubility of ferrous sulfate. The grain size of a product generally tends to be finer as the concentration of ferrous sulfate is reduced. In addition, in the reaction, the particle size is apt to be made finer as the amount of air increases and the reaction temperature is lower.

In the present invention, a hydrophobic magnetic iron oxide thus produced is preferably used.

The magnetic iron oxide to be used in the toner according to the present invention is used in an amount of preferably 10 to 200 parts by mass, more preferably 20 to 180 parts by mass, or still more preferably 40 to 160 parts by mass with respect to 100 parts by mass of the binder resin. As long as the amount falls within the above range, the toner can obtain sufficient coloring power, good developing performance, and good fixing performance.

In the present invention, an extraction $S_3$ (mass %) and an extraction $S_{15}$ (mass %) of a magnetic substance with respect to the total content of the magnetic substance at 3 minutes and 15 minutes, respectively, upon dispersing the magnetic toner in 5 mol/l hydrochloric acid preferably satisfy the following expressions.

$$0.5 \leq S_3 \leq 10 \quad (4)$$

$$40 \leq S_{15} \leq 80 \quad (5)$$

In the present invention, the presence state of the magnetic substance from the outermost surface of the magnetic toner to the inside of the toner can be estimated by changing a time period for which the toner is extracted with hydrochloric acid. In this case, it is considered that the magnetic substance present at the outermost surface portion of the toner is extracted with 5 mol/l hydrochloric acid within 3 minutes, and the amount of the magnetic substance extracted within 15 minutes indicates the abundance of the magnetic substance present from the vicinity of the surface of the toner toward the center of the toner.

In the present invention, the amount ($S_3$) of the magnetic substance when the magnetic toner is extracted with 5 mol/l hydrochloric acid for 3 minutes is 0.5% or more and 10% or less, or preferably 5% or less. Thus, when only a slight amount of the magnetic substance is present in the vicinity of the outermost surface of the toner as described above, the toner can obtain a charging characteristic excellent in environmental stability because the moisture absorption of the magnetic substance has nearly no influence on the toner. Further, even when the toner receives a stress between a developing sleeve as a toner bearing member and a control member in a magnetic one-component developing system, if the amount of liberated magnetic substance is reduced, the toner bearing member can be inhibited from being contaminated with a fine powder of the magnetic substance. In addition, the occurrence of the charge-up of the toner can be suppressed even under a low-humidity environment because the magnetic substance is suitably present in the vicinity of the surface of the toner.

In the present invention, the amount ($S_{15}$, $S_{30}$) of the magnetic substance when the magnetic toner is extracted with 5 mol/l hydrochloric acid for 15 minutes is 40% or more and 80% or less, or preferably 45% or more and 75% or less. $S_{15}$ corresponds to the amount of the magnetic substance present in the vicinity of the surface of the toner. In the present invention, the resistance of the toner to a stress can be improved by distributing the magnetic substance so as to be localized in the vicinity of the surface of the toner.

When $S_{15}$ is less than 40%, the amount of the magnetic substance present in the vicinity of the surface of the toner is small, so the resistance of the toner to a stress decreases, and the toner is apt to deteriorate when being used for a long time period. In addition, when $S_{15}$ exceeds 80%, the magnetic substance concentrates in the vicinity of the surface of the toner, so the dispersibility of the magnetic substance or other additives come to deteriorate, and a reduction in image density or an image defect is liable to occur in association with extensive operation.

In the present invention, a resin may be added to the polymerizable monomer system before polymerization. For example, when introducing into the toner a monomer component containing a hydrophilic group such as an amino group, a carboxylic acid group, a hydroxyl group, a sulfonic group, a glycidyl group, or a nitrile group, which cannot be used in a monomer form in an aqueous suspension due to such water solubility as to dissolve in the suspension to cause emulsion polymerization, the component can be used in the form of: a copolymer such as a random copolymer, block copolymer, or graft copolymer with a vinyl compound such as styrene or ethylene; a polycondensate such as polyester or polyamide; or an addition polymer such as polyether or polyimine. When such a polymer containing a polar functional group to coexist in the toner, the phase separation of the above-mentioned wax component is brought about, and the wax is enclosed further inside the toner. As a result, a toner having good offset resistance, good blocking resistance, and good low-temperature fixability can be obtained. The polymer is used in an amount of preferably 1 to 20 parts by mass with respect to 100 parts by mass of the polymerizable monomer. When the polymer is used in an amount of less than 1 part by mass, the effect of adding the polymer is small. On the other hand, when the polymer is used in an amount in excess of 20 parts by mass, it becomes difficult to design various physical properties of polymerized toner. In addition, a polymer having an average molecular weight of 3,000 or more is preferably used as such a polymer containing a polar functional group. A polymer having a molecular weight of less than 3,000, in particular, 2,000 or less is not preferable because the polymer is apt to concentrate in the vicinity of the surface of the toner, so adverse effects on, for example, the developing performance and blocking resistance of the toner are apt to occur. In addition, a toner having wide molecular weight distribution and high offset resistance can be obtained when a polymer having a molecular weight deviating from the molecular weight range of a toner obtained by polymerizing a monomer is dissolved in the monomer and polymerized.

A polyester resin as a resin to be added to the polymerizable monomer is preferably added to the toner according to the present invention.

Next, a case where the toner of the present invention is produced by a pulverization method will be described.

A preferable method of producing the particles of the toner involves: sufficiently mixing binder resins, a magnetic substance and other additives as required with a mixer such as a Henschel mixer or a ball mill; melting, kneading, and milling the mixture with a heat extruder such as a kneader or an extruder to make the resins compatible with each other; cooling the molten kneaded product to solidify the product; pulverizing the solidified product; and classifying the pulverized products to produce the toner particles. The toner can be obtained by sufficiently mixing the toner particles and external additives with a mixer such as a Henschel mixer as required.

In addition, when producing the toner of the present invention, the classification can be performed any time after the production of the toner particles, for example, after the toner particles are mixed with the external additive.

Exemplary apparatuses each of which can be generally used as an apparatus for toner production are given below. However, the present invention is not limited to the apparatuses. Table 1 lists exemplary pulverizing apparatuses for toner production, Table 2 lists exemplary classifying apparatuses for toner production, Table 3 lists exemplary screening apparatuses for toner production, Table 4 lists exemplary mixing apparatuses for toner production, and Table 5 lists exemplary kneading apparatuses for toner production.

TABLE 1

Examples of pulverizing machines for manufacturing toner

| Name of Device | Manufacturer |
|---|---|
| Counter Jet Mill | Hosokawa Micron Corporation |
| Micron Jet | Hosokawa Micron Corporation |
| IDS-type Mill | Nippon Pneumatic MFG Co., Ltd. |
| PJM Jet Grinding Mill | Nippon Pneumatic MFG Co., Ltd. |
| Cross Jet Mill | Kurimoto, Ltd. |
| Ulmax | Nisso Engineering Co., Ltd. |
| SK Jet O-Mill | Seishin Enterprise Co., Ltd. |
| Criptron | Kawasaki Heavy Industries, Ltd. |
| Turbo Mill | Turbo Kogyo Co., Ltd. |
| Inomizer | Hosokawa Micron Corporation |

TABLE 2

Examples of classifiers for manufacturing toner

| Name of Device | Manufacturer |
|---|---|
| Classyl | Seishin Enterprise Co., Ltd. |
| Micron Classifier | Seishin Enterprise Co., Ltd. |
| Spedic Classifier | Seishin Enterprise Co., Ltd. |
| Turbo Classifier | Nisshin Engineering Inc. |
| Micron Separator | Hosokawa Micron Corporation |
| Turboprex (ATP) | Hosokawa Micron Corporation |
| TSP Separator | Hosokawa Micron Corporation |
| Elbow Jet | Nittetsu Mining Co., Ltd. |
| Dispersion Separator | Nippon Pneumatic MFG Co., Ltd. |
| YM Microcut | Yasukawa Shoji K.K. |

TABLE 3

Examples of sifters for manufacturing toner

| Name of Device | Manufacturer |
|---|---|
| Ultrasonics | Koei Sangyo Co., Ltd. |
| Rezona Sieve | Tokuju Corporation |
| Vibrasonic Sifter | Dulton Co., Ltd. |
| Sonicreen | Shinto Kogyo K.K. |
| Gyro System | Tokuju Corporation |
| circular vibrating screens | Plural manufacturers |
| Turbo-Screener | Turbo Kogyo Co., Ltd. |
| Microsifter | Makino Mfg. Co., Ltd. |

TABLE 4

Examples of mixing machines for manufacturing toner

| Name of Device | Manufacturer |
|---|---|
| Henschel Mixer | Mitsui Mining & Smelting Co., Ltd. |
| Super Mixer | Kawata MFG Co., Ltd. |
| Conical Ribbon Mixer | Y.K. Ohkawara Seisakusho |
| Nauta Mixer | Hosokawa Micron Corporation |
| Spiral Pin Mixer | Pacific Machinery & Engineering Co., Ltd. |
| Rhedige Mixer | Matsubo Corporation |
| Turbulizer | Hosokawa Micron Corporation |
| Cyclomix | Hosokawa Micron Corporation |

TABLE 5

Examples of kneading machines for manufacturing toner

| Name of deivce | Manufacturer |
|---|---|
| KRC kneader | Kurimoto, Ltd. |
| Buss·Co·Kneader | Coperion Buss Ag. |
| TEM-type Extruder | Toshiba Machine Co., Ltd. |
| TEX Twin-screw Extruder | The Japan Steel Works, Ltd. |
| PCM Kneader | Ikegai Corporation |
| Three-Roll Mill | Inoue Manufacturing Co., Ltd. |
| Mixing Roll Mill | Inoue Manufacturing Co., Ltd. |
| Kneader | Inoue Manufacturing Co., Ltd. |
| Kneadex | Mitsui Mining & Smelting Co., Ltd. |
| MS-type Pressure Kneader | Moriyama Manufacturing Co., Ltd. |
| Kneader-Ruder | Moriyama Manufacturing Co., Ltd. |
| Banbury Mixer | Kobe Steel, Ltd. |

In the present invention, in order that the compressibility of the toner obtained by the pulverization method and the total energy of the toner measured with a powder flowability measuring apparatus can be controlled, the following method is also preferably employed: high-temperature hot air is momentarily blown on the surfaces of the resultant toner particles, and immediately after that, the shapes and surfaces of the magnetic toner particles are modified with an apparatus for cooling the toner particles with cold air. The modification of the surfaces of the magnetic toner particles by heat treatment based on such approach does not involve the application of excess heat to the toner particles, so the surfaces of the toner particles can be modified while raw material components for the toner are prevented from being denatured. In addition, the toner particles are instantaneously cooled, so a phenomenon does not occur in which the toner particles coalesce excessively to have a toner particle diameter largely fluctuating from that before the surface modification. As a result, the physical properties of the toner after the surface modification can be easily controlled even in a toner production process. As such an apparatus, for example, a Meteorainbow (manufactured by Nippon Pneumatic Mfg. Co., Ltd.) may be cited.

In the present invention, in a wettability test of the magnetic toner obtained by the pulverization method with a mixed solvent of methanol and water, a methanol concentration when a transmittance is equal to 50% of the initial transmittance is preferably 60 vol % or more and 80 vol % or less. When setting the methanol concentration to 60 vol % or more and 80 vol % or less, the affinity of the toner for water is made suitable, the toner can hold suitable charge even under a high-humidity environment, and even under a low-humidity environment, it is possible to suppress the occurrence of problems such as deterioration in the uniformity of toner coating on a developing sleeve and a reduction in image density due to a charge-up phenomenon, and the adhesion of the toner to a charge-providing member or photosensitive member. The wettability of the toner can be adjusted by controlling: a state in which a release agent is exposed to the surface of the toner; or the hydrophobicity or the amount of the inorganic fine powder to be added.

Examples of the binder resin to be used when the toner is produced by the pulverization method in the present invention include a polyester resin, a styrene-acrylic resin, a hybrid resin containing a polyester resin component and a styrene-acrylic resin component, an epoxy resin, a styrene-butadiene resin, and a polyurethane resin, but conventionally known resin can be used without any particular limitation. Of those resins, the polyester resin, the hybrid resin, and the like are particularly preferable in terms of, for example, the fixing performance of the toner.

Examples of the monomers of the polyester resin and polyester resin component to be used in the present invention include the following monomers.

Examples of an alcohol component include: ethylene glycol; propylene glycol; 1,3-butanediol; 1,4-butanediol; 2,3-butanediol; diethylene glycol; triethylene glycol; 1,5-pentanediol; 1,6-hexanediol; neopentyl glycol; 2-ethyl-1,3-hexanediol; hydrogenated bisphenol A; and a bisphenol derivative represented by the following formula (I); and diols each represented by the following formula (II).

(I)

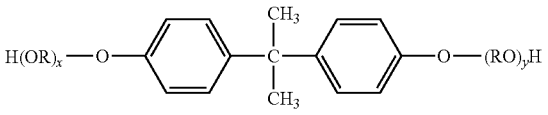

(In the formula, R represents an ethylene or propylene group, x and y each represent an integer of 1 or more, and the average of x+y is 2 to 10.)

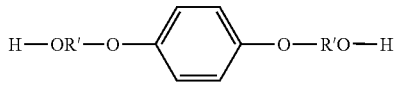

(II)

(In the formula, R' represents —$CH_2CH_2$—,

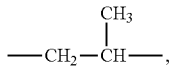

or

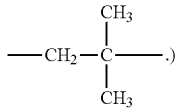

Examples of a divalent carboxylic acid accounting for 50 mol % or more of total acid components include: benzene dicarboxylic acids, or anhydrides thereof such as phthalic acid, terephthalic acid, isophthalic acid, and phthalic anhydride; alkyldicarboxylic acids, or anhydrides thereof such as succinic acid, adipic acid, sebacic acid, and azelaic acid; succinic acid substituted with an alkyl group having 6 to 18 carbon atoms or anhydrides thereof; and unsaturated dicarboxylic acids, or anhydrides thereof such as fumaric acid, maleic acid, citraconic acid, and itaconic acid.

In addition, the following may be cited: glycerine, pentaerythritol, solbit, sorbitan, polyalcohols such as oxyalkylene ether of novolac type phenol resin, and polycarboxylic acids such as trimellitic acid, pyromellitic acid, benzophenonetetracarboxylic acid, and anhydrides thereof.

As vinyl-type monomers to produce styrene-acrylic resins, the following substances are exemplified: styrenes such as o-methylstyrene, m-methylstyrene, p-methylstyrene, p-phenylstyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, p-chlorostyrene, 3,4-dichlorostyrene, m-nitrostyrene, o-nitrostyrene, and p-nitrostyrene and derivatives thereof; ethylenically unsaturated monoolefins such as ethylene, propylene, butylene, and isobutylene; unsaturated polyenes such as butadiene and isoprene; vinyl halides such as vinyl chloride, vinylidene chloride, vinyl bromide, and vinyl fluoride; vinyl esters such as vinyl acetate, vinyl propionate, and vinyl benzoate; α-methylene aliphatic monocarboxylates such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; acrylates such as methyl acrylate, ethyl acrylate, propyl acrylate, n-butyl acrylate, isobutyl acrylate, n-octyl acrylate, dodecyl acrylate, 2-ethylhexyl acrylate, stearyl acrylate, 2-chloroethyl acrylate, and phenyl acrylate; vinyl ethers such as vinyl methyl ether, vinyl ethyl ether, and vinyl isobutyl ether; vinyl ketones such as vinyl methyl ketone, vinyl hexyl ketone, and methyl isopropenyl ketone; N-vinyl compounds such as N-vinylpyrrole, N-vinylcarbazole, N-vinylindole, and N-vinylpyrrolidone; vinylnaphthalines; and acrylate or methacrylate derivatives such as acrylonitrile, methacrylonitrile, and acrylamide.

Further, the following may be cited: unsaturated dibasic acids such as maleic acid, citraconic acid, itaconic acid, alkenylsuccinic acid, fumaric acid, and mesaconic acid; unsaturated dibasic acid anhydrides such as maleic anhydride, citraconic anhydride, itaconic anhydride, and alkenylsuccinic anhydride; unsaturated basic acid half esters such as methyl maleate half ester, ethyl maleate half ester, butyl maleate half ester, methyl citraconate half ester, ethyl citraconate half ester, butyl citraconate half ester, methyl itaconate half ester, methyl alkenylsuccinate half ester, methyl fumarate half ester, and methyl mesaconate half ester; unsaturated basic acid esters such as dimethyl maleate and dimethyl fumarate; α,β-unsaturated anhydrides such as acrylic acid, methacrylic acid, crotonic acid, and cinnamic acid; anhydrides of the above-mentioned α,β-unsaturated acids and lower fatty acids; and monomers each having a carboxyl group such as alkenylmalonic acid, alkenylglutaric acid, and alkenyladipic acid, and acid anhydrides thereof and monoesters thereof.

Further, examples of the monomers include: acrylic esters or mathacrylic esters such as 2-hydroxylethyl acrylate, 2-hydroxylethyl methacrylate, and 2-hydroxylpropyl methacrylate; and monomers having a hydroxyl group such as 4-(1-hydroxy-1-methylbutyl)styrene and 4-(1-hydroxy-1-methylhexyl)styrene.

In addition, polymers crosslinked by crosslinkable monomers as exemplified below may be used as required.

Examples of aromatic divinyl compounds include divinyl benzene and divinyl naphthalene. Examples of the diacrylate compounds bonded by alkyl chains include: ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, and those obtained by changing the acrylate of the above-mentioned compounds to methacrylate. Examples of the diacrylate compounds bonded by alkyl chains containing an ether bond include: diethylene glycol diacrylate, triethylene glycol diacrylate, tetraethylene glycol diacrylate, polyethylene glycol #400 diacrylate, polyethylene glycol #600 diacrylate, dipropylene glycol diacrylate, and those obtained by changing the acrylate of the above-mentioned compounds to methacrylate. Examples of the diacrylate compounds bonded by chains containing an aromatic group and an ether bond include: polyoxyethylene(2)-2,2-bis(4-hydroxyphenyl)propane diacrylate and polyoxyethylene(4)-2,2-bis(4-hydroxyphenyl)propane diacrylate; and those obtained by changing the acrylate of the above-mentioned compounds to methacrylate. An example of the polyester type diacrylates includes MANDA (trade name; Nippon Kayaku Co., Ltd.).

Example of the polyfunctional crosslinking agent include: pentaerythritol triacrylate, trimethylolethane triacrylate, trimethylolpropane triacrylate, tetramethylolmethane tetraacrylate, and oligoester acrylate; those obtained by changing the acrylate of the above-mentioned compounds to methacrylate; triallyl cyanurate; and triallyl trimellitate.

Those crosslinking agent can be used in an amount of preferably 0.01 to 10 mass % (or more preferably 0.03 to 5 mass %) with respect to 100 mass % of the other monomer components.

Examples of monomers to be suitably used in a resin for a toner in terms of fixability and offset resistance out of those crosslinkable monomers include aromatic divinyl compounds (in particular, divinylbenzene) and diacrylate compounds bonded by chains containing an aromatic group and an ether bond.

Examples of polymerization initiators used when the styrene-acrylic resin in the present invention is produced include: 2,2'-azobisisobutyronitrile, 2,2'-azobis(4-methoxy-2,4-dimethylvaleronitrile), 2,2'-azobis(2,4-dimethylvaleronitrile), 2,2'-azobis(2-methylbutyronitrile), dimethyl-2,2'-azobisisobutylate, 1,1'-azobis(1-cyclohexanecarbonitrile), 2-carbamoylazoisobutyronitrile, 2,2'-azobis(2,4,4-trimethylpentane), 2-phenylazo-2,4-dimethyl-4-methoxyvaleronitrile, 2,2'-azobis(2-methylpropane), ketone peroxides such as methyl ethyl ketone peroxide, acetylacetone peroxide, and cyclohexanone peroxide, 2,2-bis(t-butylperoxy)butane, t-butyl hydroperoxide, cumene hydroperoxide, 1,1,3,3-tetramethylbutyl hydroperoxide, di-t-butyl peroxide, t-butylcumyl peroxide, dicumyl peroxide, α,α'-bis(t-butylperoxyisopropyl)benzene, isobutyl peroxide, octanoyl peroxide, decanoyl peroxide, lauroyl peroxide, 3,5,5-trimethylhexanoyl peroxide, benzoyl peroxide, m-trioyl peroxide, diisopropyl peroxydicarbonate, di-2-ethylhexyl peroxydicarbonate, di-n-propyl peroxydicarbonate, di-2-ethoxyethyl peroxycarbonate, dimethoxyisopropyl peroxydicarbonate, di(3-methyl-3-methoxybutyl) peroxycarbonate, acetylcyclohexylsulfonyl peroxide, t-butyl peroxyacetate, t-butyl peroxyisobutyrate, t-butyl peroxyneodecanoate, t-butyl peroxy-2-ethylhexanoate, t-butyl peroxylaurate, t-butyl peroxybenzoate, t-butylperoxyisopropyl carbonate, di-t-butyl peroxyisophthalate, t-butyl peroxyallylcarbonate, t-amyl peroxy-2-ethylhexanoate, di-t-butyl peroxyhexahydroterephthalate, and di-t-butyl peroxyazelate.

When a hybrid resin formed of a polyester resin component and a styrene-acrylic resin component is synthesized, it is necessary to contain a monomer component capable of reacting with both the polyester resin component and the styrene-acrylic resin component described above. A monomer capable of reacting with the styrene-acrylic resin component out of the monomers capable of forming the polyester resin component is, for example, an unsaturated dicarboxylic acid such as fumaric acid, maleic acid, citraconic acid, or itaconic acid, or an anhydride of the unsaturated dicarboxylic acid. A monomer capable of reacting with the polyester resin component out of the monomers each capable of forming the styrene-acrylic resin component is, for example, a monomer having a carboxyl group or hydroxyl group, or an acrylate or methacrylate.

A preferable method of obtaining the hybrid resin involves subjecting one or both of the vinyl-based resin and the polyester resin listed earlier to a polymerization reaction in the presence of a polymer containing a monomer component capable of reacting with each of the resins.

In the present invention, a release agent can also be contained as required.

Examples of the release agent that can be used for the toner of the present invention include: aliphatic hydrocarbon-type wax such as low-molecular weight polyethylene, low-molecular weight polypropylene, microcrystalline wax, and paraffin wax; oxides of aliphatic hydrocarbon-type wax such as polyethylene oxide wax or block copolymers thereof; wax mainly composed of fatty acid esters such as carnauba wax, sasol wax, and montan acid ester wax; partially or wholly deacidified fatty acid esters such as deacidified carnauba wax; saturated straight-chain fatty acids such as palmitic acid, stearic acid, and montanic acid; unsaturated fatty acids such as brassidic acid, eleostearic acid, and parinaric acid; saturated alcohols such as stearyl alcohol, aralkyl alcohol, behenyl alcohol, carnaubyl alcohol, ceryl alcohol, and melissyl alcohol; polyhydric alcohols such as sorbitol; fatty acid amides such as amide linoleate, amide oleate, and amide laurate; saturated fatty acid bisamides such as methylenebis amide stearate, ethylenebis amide caprate, ethylenebis amide laurate, and hexamethylenebis amide stearate; unsaturated fatty acid amides such as ethylenebis oleic acid amide, hexamethylenebis oleic acid amide, N,N'-dioleyl adipic acid amide, and N,N'-dioleyl sebacic acid amide; aromatic bisamides such as m-xylene searic acid amide and N'N-distearyl isophthalic acid amide; aliphatic metal salts (which are generally referred to as metallic soap) such as calcium stearate, calcium laurate, zinc stearate, and magnesium stearate; wax obtained by grafting aliphatic hydrocarbon-type wax with vinyl-type monomers such as styrene and acrylic acid; partially esterified compounds of fatty acids and polyhydric alcohols such as behenic monoglyceride; methyl ester compounds each having a hydroxyl group obtained by the hydrogenation of vegetable oil; and long-chain alkyl alcohols or long-chain alkyl carboxylic acids having 12 or more carbon atoms.

Examples of a release agent that can be contained in the toner include aliphatic hydrocarbon-type wax. Examples of the aliphatic hydrocarbon-type wax include: a low-molecular weight alkylene polymer obtained by subjecting an alkylene to radical polymerization under high pressure or by polymerizing an alkylene under low pressure by using a Ziegler catalyst; an alkylene polymer obtained by thermal decomposition of a high-molecular weight alkylene polymer; synthetic hydrocarbon wax obtained from a distillation residue of a hydrocarbon obtained by an Age method from a synthetic gas containing carbon monoxide and hydrogen, and synthetic hydrocarbon wax obtained by hydrogenation of the gas; and wax obtained by fractionating aliphatic hydrocarbon-type wax by a press sweating method, a solvent method, or vacuum distillation or according to a fractional crystallization method.

Examples of a hydrocarbon as a matrix of the above aliphatic hydrocarbon-type wax include: one synthesized by a reaction between carbon monoxide and hydrogen using a metal oxide-type catalyst (a multiple-element system composed of two or more types of elements in many cases) (such as a hydrocarbon compound synthesized by a synthol method or a hydrocol method (involving the use of a fluid catalyst bed)); a hydrocarbon having several hundred of carbon atoms obtained by an Age method (involving the use of an identification catalyst bed) in which a large amount of a wax-like hydrocarbon can be obtained; and a hydrocarbon obtained by polymerizing an alkylene such as ethylene by using a Ziegler catalyst. Of such hydrocarbons, in the present invention, a small, saturated, and long straight-chain hydrocarbon with a small number of branches is preferable, and a hydrocarbon synthesized by a method not involving the polymerization of an alkylene is particularly preferable because of its molecular weight distribution.

In the present invention, in terms of the low-temperature fixability and high-temperature offset resistance of the toner, the release agent is preferably incorporated into toner particles so that the temperature of an endothermic main peak appears in the region of 50 to 90° C. in a DSC curve obtained by measuring the toner particles containing the release agent with a differential scanning calorimeter. When the temperature of the endothermic main peak in the DSC measurement falls within the above range, the toner can obtain good fixing performance, and moreover, the exudation of a wax component in an environment in which the toner is stored can be suitably suppressed, so the toner can obtain excellent storage stability. In addition, good granulating performance can be obtained even when the toner particles are directly obtained by a polymerization method in an aqueous medium.

The above temperature of the endothermic peak can be measured with a high-precision differential scanning calorimeter of an inner heat input compensation type such as a DSC-7 manufactured by PerkinElmer Co., Ltd. in conformity with ASTM D3418-82. The temperature at which the above peak appears can be adjusted by using a release agent with its melting point, glass transition point, degree of polymerization, and the like appropriately adjusted. It should be noted that the DSC-7 described above is applicable to the measurement of temperatures at which toner particles and toner particle materials show thermophysical properties such as the glass transition point and softening point of the binder resin, and the melting point of the wax as well as the measurement of the above temperature of the peak.

Specific examples of wax that can be used as a release agent in the present invention include: Biscol (trade mark) 330-P, 550-P, 660-P, and TS-200 (Sanyo Chemical Industries, Ltd.); Hiwax 400P, 200P, 100P, 410P, 420P, 320P, 220P, 210P, and 100P (Mitsui Chemicals, Inc.); Sasol H1, H2, C80, C105, and C77 (Schumann Sasol); HNP-1, HNP-3, HNP-9, HNP-10, HNP-11, and HNP-12 (NIPPON SEIRO CO., LTD); Unilin (trade mark) 350, 425, 550, and 700 and Unisid (trade mark), Unisid (trade mark) 350, 425, 550, and 700 (TOYO-PETROLITE); and haze wax, beeswax, rice wax, candelilla wax, and carnauba wax (available from CERARICA NODA Co., Ltd.).

The toner according to the present invention may be blended with a charge control agent in order that the charging characteristic of the toner may be stabilized. A known charge control agent can be utilized, but a charge control agent that allows the toner to be charged at a high speed and to maintain a constant charge quantity stably is particularly preferable.

A specific compound to serve as the charge control agent is a negative charge control agent or a positive charge control agent. Examples of the negative charge control agent include: metal compounds of aromatic carboxylic acids such as salicylic acid, an alkylsalicylic acid, a dialkylsalicylic acid, naphthoic acid, and a dicarboxylic acid; metal salts or metal complexes of azo dyes or of azo pigments; polymeric compounds each having a sulfonic group or carboxylic acid group in its side chain; boron compounds; urea compounds; silicon compounds; and calixarene. Examples of the positive charge control agent include: quaternary ammonium salts; polymeric compounds having quaternary ammonium salts in their side chains; guanidine compounds; nigrosin-type compounds; and imidazole compounds. The charge control agent is preferably used in an amount of 0.5 to 10 parts by mass with respect to 100 parts by mass of the binder resin. However, the addition of the charge control agent is not necessarily required for the toner according to the image-forming method of the present invention, and active utilization of triboelectric charging with a toner layer thickness control member or toner bearing member eliminates the need for the incorporation of the charge control agent into the toner.

More specific examples of the charge control agent used for negative charging more preferably include: Spilon Black TRH, T-77, and T-95 (Hodogaya Chemical Co., Ltd.); and BONTRON (trademark) S-34, S-44, S-54, E-84, E-88, and E-89 (Orient Chemical Industries, LTD.). More specific examples of the charge control agent preferably used for positive charging include: TP-302 and TP-415 (Hodogaya Chemical Co., Ltd.); BONTRON (trademark) N-01, N-04, N-07, and P-51 (Orient Chemical Industries, LTD.); and Copy Blue PR (Clariant).

In the present invention, the magnetic iron oxide particles may have an additional function as a colorant, and a colorant other than the magnetic iron oxide particles may be used together. As the coloring material that can be used together, magnetic or non-magnetic inorganic compounds and known dyes and pigments are exemplified. Specific examples thereof include ferromagnetic metallic particles such as cobalt and nickel, alloys thereof obtained by adding chromium, manganese, copper, zinc, aluminum, and rare earth elements, hematite, titanium black, and nigrosine dyes/pigments, carbon black, and phthalocyanine. Those may also be used after being subjected to surface treatment.

The toner according to the present invention is used after various materials in accordance with the type of toner have been externally added to the above-mentioned toner particles. Examples of the materials to be externally added include external additives such as: a flowability-improving agent for improving the flowability of the toner such as an inorganic fine powder; and a conductive fine powder for adjusting the charging performance of the toner such as a metal oxide fine particle.

As the above-mentioned flowability-improving agent, an agent may be cited which can be externally added to toner particles to improve flowability of toner. Examples of such flowability-improving agent include: silica fine powder such as silica obtained through a wet process or silica obtained through a dry process; fine powdered titanium oxide, fine powdered alumina, and treated silica, treated titanium oxide, and treated alumina, which have been subjected to surface treatment with a silane coupling agent, a titanium coupling agent, silicone oil, or the like.

The flowability-improving agent has a specific surface area of preferably 30 $m^2/g$ or more, or more preferably 50 $m^2/g$ or more, as measured by a BET method based on nitrogen adsorption. For example, the flowability-improving agent is blended in an amount of preferably 0.01 to 5 parts by mass, or more preferably 0.1 to 3 parts by mass with respect to 100 parts by mass of the toner particles, though the preferable amount varies depending on the type of the flowability-improving agent.

A preferable flowability-improving agent is a fine powder produced through vapor phase oxidation of a silicon halide compound, with the fine powder being called dry process silica or fumed silica. For example, such silica is produced by utilizing a thermal decomposition oxidation reaction of a silicon tetrachloride gas in oxygen or hydrogen, and a basic reaction formula for the reaction is represented by the following formula (6):

$$SiCl_4+2H_2+O_2 \rightarrow SiO_2+4HCl \quad (6)$$

In the production process, composite fine powders of silica and other metal oxides can also be obtained by using a silicon halide compound together with other metal halide compounds such as aluminum chloride or titanium chloride in the production process, and the silica fine powder used as a flowability-improving agent in the present invention includes such composite fine powders as well. The silica fine powder has an average primary particle diameter in the range of preferably 0.001 to 2 μm, and particularly 0.002 to 0.2 μm.

Examples of a commercially available silica fine powder produced through the vapor phase oxidation of a silicon halide compound include those commercially available under the following trade names, that is, AEROSIL (NIPPON AEROSIL CO., LTD.) 130, 200, 300, 380, TT600, MOX170, MOX80, and COK84; Ca-O-SiL (CABOT Co.) M-5, MS-7, MS-75, HS-5, and EH-5; Wacker HDK N 20 (WACKER-CHEMIE GMBH) V15, N20E, T30, and T40; D-CFine Silica (DOW CORNING Co.); and Fransol (Francil).

In the present invention, the above silica fine powder is preferably subjected to hydrophobic treatment. In addition, it is particularly preferable in controlling the wettability of the toner that the above silica fine powder is treated so that a degree of hydrophobicity measured by a methanol titration test is in the range of 30 to 80 degrees. It should be noted that the above degree of hydrophobicity is represented in terms of a percentage of methanol in a liquid mixture of methanol and water at the time that sedimentation of a predetermined amount of the silica fine powder is completed where the silica powder is stirred in water while methanol is dropped to the silica fine powder. As a method of making the silica fine powder hydrophobic, for example, a method may be cited in which silica fine particles is chemically treated with an organic silicon compound or silicone oil which reacts with the silica fine powder or physically adsorbs to the silica fine particles, and hydrophobic treatment with the organic silicon compound is more preferable. Examples of the above-mentioned organic silicon compound include hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, triorganosilylmercaptan, trimethylsilylmercaptan, triorganosilylacrylate, vinyldimethylacetoxysilane, dimethylethoxysilane, dimethyldimethoxysilane, diphenyldiethoxysilane, hexamethyldisiloxane, 1,3-divinyltetramethyldisiloxane, 1,3-diphenyltetramethyldisiloxane, and dimethylpolysiloxane which has 2 to 12 siloxane units per molecule and contains a hydroxyl group bound to Si in a unit located in each of terminals. One of these compounds is used singly or in combination.

In the hydrophobic treatment of the silica fine powder, one or two or more types of silane coupling agents having nitrogen atoms can be used out of the above-mentioned organic silicon compounds. Examples of such a nitrogen-containing silane coupling agent include aminopropyltrimethoxysilane, aminopropyltriethoxysilane, dimethylaminopropyltrimethoxysilane, diethylaminopropyltrimethoxysilane, dipropylaminopropyltrimethoxysilane, dibutylaminopropyltrimethoxysilane, monobutylaminopropyltrimethoxysilane, dioctylaminopropyldimethoxysilane, dibutylaminopropyldimethoxysilane, dibutylaminopropylmonomethoxysilane, dimethylaminophenyltriethoxysilane, trimethoxysilyl-γ-propylphenylamine, and trimethoxysilyl-γ-propylbenzylamine.

Here, as a preferable silane coupling agent, hexamethyldisilazane (HMDS) may be cited.

Silicone oil preferably used in the hydrophobic treatment of a silica fine powder has a viscosity at 25° C. of preferably 0.5 cSt or more and 10,000 cSt or less, more preferably of 1 or more and 1,000 cSt or less, and still more preferably of 10 or more and 200 cSt or less. In addition, examples of particularly preferable silicone oil include dimethyl silicone oil, methylphenyl silicone oil, α-methylstyrene-modified silicone oil, chlorophenyl silicone oil, and fluorine-modified silicone oil.

A method of subjecting the surface of the silica fine powder to hydrophobic treatment with silicone oil is, for example, a method involving directly mixing the silica fine powder treated with a silane coupling agent and silicone oil with a mixer such as a Henschel mixer, a method involving spraying silicone oil on the silica fine powder as a base, or a method involving dissolving or dispersing silicone oil in a proper solvent, adding the silica fine powder to the solution or dispersion liquid, mixing the whole, and removing the solvent.

When the surface of the silica fine powder is subjected to hydrophobic treatment with silicone oil, the surface coat is preferably stabilized by heating the silica fine powder to 200° C. or higher (more preferably 250° C. or higher) in an inert gas after the treatment with silicone oil.

In the present invention, both the silane coupling agent described above and the silicone oil can be used in hydrophobic treatment for the surface of the silica fine powder. Examples of such a method for the hydrophobic treatment for the surface include: a method involving treating the silica fine powder with the silane coupling agent in advance and treating the resultant with silicone oil; and a method involving treating the silica fine powder with the silane coupling agent and silicone oil simultaneously.

Further, external additives other than the flowability-improving agent may be added to the toner according to the present invention as required.

For example, in one preferred embodiment, fine particles having a primary particle diameter in excess of 30 nm, or more preferably nearly spherical inorganic or organic fine particles having a primary particle diameter of 100 nm or more are further added to the toner particles for the purpose of, for example, adjusting the compressibility of the toner. For example, spherical silica particles, spherical polymethylsilsesquioxane particles, or spherical resin particles are preferably used.

The addition of such particles makes it easy to optimize the compressibility of the magnetic toner and the total energy of the toner measured with a powder flowability measuring apparatus.

Further, small amounts of other additives may be added, for example: a lubricant powder such as a polyethylene fluoride powder, a zinc stearate powder, or a polyvinylidene fluoride powder; an abrasive such as a cerium oxide powder, a silicon carbide powder, or a strontium titanate powder; a caking inhibitor; a conductivity-imparting agent such as a carbon black powder, a zinc oxide powder, or a tin oxide powder; or organic and inorganic fine particles opposite in polarity as a developing performance-improving agent. The surfaces of such additives can be subjected to hydrophobic treatment before the additives are used.

Such external additives as described above are preferably used in an amount of 0.1 to 2 parts by mass (more preferably 0.1 to 1.5 parts by mass) with respect to 100 parts by mass of the magnetic toner particles in terms of the fixing performance and charging characteristic of the toner.

Methods of measuring various physical properties in the present invention are described below in detail.

(1) Method of Measuring Compressibility of Toner

The apparent density and tap density of toner are measured in conformance with JIS K5101.

(2) Methods of Measuring $TE_{10}$ and $TE_{100}$ $TE_{10}$ (mJ) and $TE_{100}$ (mJ) in the present invention are measured with a powder flowability analyzer Powder Rheometer FT-4 (manufactured by Freeman Technology) (hereinafter abbreviated as "FT-4").

Figure 2A:
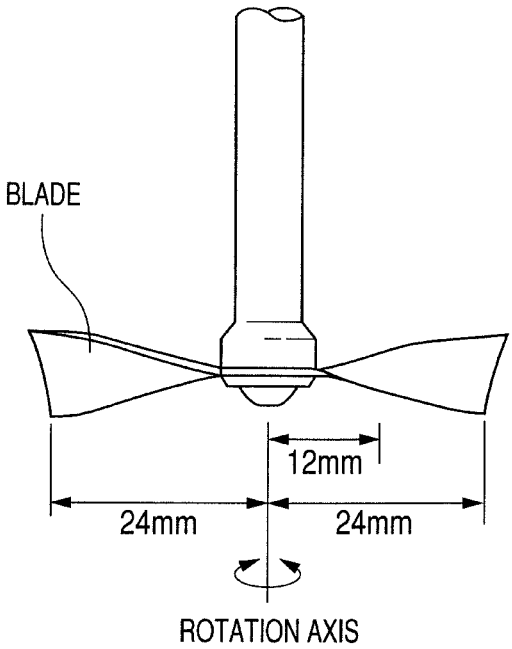
FIGS. 2A and 2B are each a schematic view of a propeller type blade of a powder flowability analyzer to be used in total energy measurement.
Figure 2B:
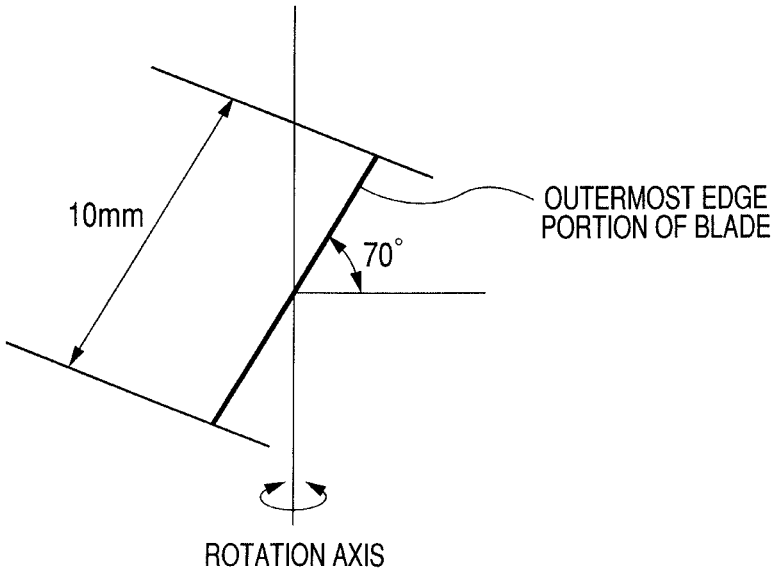

To be specific, the measurement is performed by the following operations. A blade dedicated for measurement with the FT-4 having a diameter of 48 mm shown in each of FIGS. 2A and 2B is used as a propeller type blade in all the operations. The blade dedicated for measurement with the FT-4 having a diameter of 48 mm has a rotation axis at the center of a blade plate measuring 48 mm by 10 mm in the direction normal to the center. The blade plate is one (material: SUS, model: C210) twisted smoothly in a counterclockwise direction as follows: both outermost edge portions (portions placed at a distance of 24 mm from the rotation axis) form an angle of 70° relative to the horizontal plane, and portions placed at a distance of 12 mm from the rotation axis form an angle of 35° relative to the horizontal plane.

100 g of toner left standing under an environment having a temperature of 23° C. and a humidity of 50% for 3 days or longer are loaded into a cylindrical split cell dedicated for measurement with the FT-4 having a diameter of 50 mm and a volume of 160 ml (model: C203, height from the bottom surface of the container to a split portion 82 mm, material: glass) so that a toner powder layer is formed.

(1) Conditioning Operation (a) The blade is caused to penetrate from the surface of the toner powder layer toward a position at a distance of 10 mm from the bottom surface of the powder layer under the following conditions: the rotational speed (circumferential speed) of each outermost edge portion of the blade in a clockwise direction relative to the surface of the powder layer (direction in which the powder layer is loosened by the rotation of the blade) is 60 (mm/sec); and the speed at which the blade is caused to penetrate into the powder layer in the direction perpendicular to the layer is such that an angle formed between a path taken by each outermost edge portion of the blade during the movement and the surface of the powder layer is 5 (deg) (hereinafter abbreviated as "angle formed" in some cases). After that, the operation of causing the blade to penetrate into a position at a distance of 1 mm from the bottom surface of the toner powder layer is performed under the following conditions: the rotational speed of the blade in the clockwise direction relative to the surface of the powder layer is 60 (mm/sec); and the speed at which the blade is caused to penetrate into the powder layer in the direction perpendicular to the layer is such that the angle formed is 2 (deg). After that, the blade is moved toward a position at a distance of 100 mm from the bottom surface of the toner powder layer under the following conditions so as to be pulled out: the rotational speed of the blade in the clockwise direction relative to the surface of the powder layer is 60 (mm/sec); and the speed at which the blade is pulled out of the powder layer is such that the angle formed is 5 (deg). After the completion of the pulling-out, the blade is rotated in the clockwise and counterclockwise directions alternately to a small extent so that the toner adhering to the blade is shaken off.

(b) A series of operations in the above section (1)-(a) is performed five times so that air involved in the toner powder layer is removed. Thus, a stable toner powder layer is produced.

(2) Split Operation

The toner powder layer is leveled off at the split portion of the cell dedicated for measurement with the FT-4 as mentioned above, and the toner in the upper portion of the powder layer is removed, whereby toner powder layers having the same volume are formed.

(3) Measurement Operation (i) Measurement of $TE_{100}$ (a) A conditioning operation similar to that of the above section (1)-(a) is performed once. Next, the blade is caused to penetrate into a position at a distance of 10 mm from the bottom surface of a toner powder layer under the following conditions: the rotational speed of the blade in a counterclockwise direction relative to the surface of the powder layer (direction in which the powder layer is squeezed by the rotation of the blade) is 100 (mm/sec); and the speed at which the blade is caused to penetrate into the powder layer in the direction perpendicular to the layer is such that the angle formed is 5 (deg). After that, the operation of causing the blade to penetrate into a position at a distance of 1 mm from the bottom surface of the powder layer is performed under the following conditions: the rotational speed of the blade in the clockwise direction relative to the surface of the powder layer is 60 (mm/sec); and the speed at which the blade is caused to penetrate into the powder layer in the direction perpendicular to the layer is such that the angle formed is 2 (deg). After that, the blade is pulled out toward a position at a distance of 100 mm from the bottom surface of the powder layer under the following conditions: the rotational speed of the blade in the clockwise direction relative to the surface of the powder layer is 60 (mm/sec); and the speed at which the blade is pulled out of the powder layer in the direction perpendicular to the layer is such that the angle formed is 5 (deg). After the completion of the pulling-out, the blade is rotated in the clockwise and counterclockwise directions alternately to a small extent so that the toner adhering to the blade is shaken off.

(b) A series of the above operations is repeated seven times. At the seventh repetition, measurement is initiated from the position at a distance of 100 mm from the bottom surface of the toner powder layer at a rotational speed of the blade of 100 (mm/sec). The sum total Et of a rotation torque and a vertical load obtained when the blade is caused to penetrate into the position at a distance of 10 mm from the bottom surface is defined as $TE_{100}$.

(ii) Measurement of $TE_{10}$ (a) First, the operation of the above section (3)-(i)-(a) is performed once by using the toner powder layer for which the measurement of $TE_{100}$ has been completed.

(b) Next, measurement is performed while the blade is caused to penetrate into the toner powder layer with the rotational speed reduced to 70 (mm/sec) from 100 (mm/sec) in a series of operations in the above section (3)-(i)-(a).

(c) Subsequently, measurement is performed while the number of revolutions is reduced to 40 (mm/sec) and then to 10 (mm/sec) sequentially as in the case of the section (3)-(ii)-(b). Measurement is initiated from a position at a distance of 100 mm from the bottom surface of the toner powder layer at a rotational speed of the blade of 100 (mm/sec). The sum total of a rotation torque and a vertical load obtained when the blade is caused to penetrate into a position at a distance of 10 mm from the bottom surface is defined as $TE_{10}$.

(3) Methods of measuring weight average particle diameter (D4) and number average particle diameter (D1) of toner Measurement was made using a precision grain size distribution measuring apparatus based on a pore electrical resistance method provided with a 100-μm aperture tube "Coulter Counter Multisizer 3" (registered trademark, manufactured by Beckman Coulter, Inc) and dedicated software attached to the apparatus "Beckman Coulter Multisizer 3 Version 3.51" (manufactured by Beckman Coulter, Inc) for setting measurement conditions and analyzing measurement data. The weight average particle diameter (D4) and number average particle diameter (D1) of the toner were calculated by analyzing the measurement data.

An electrolyte solution prepared by dissolving special grade sodium chloride in ion-exchange water to have a concentration of about 1 mass %, for example, an "ISOTON II" (manufactured by Beckman Coulter, Inc) can be used in the measurement.

The dedicated software was set as described below prior to the measurement and the analysis.

In the "change standard measurement method (SOM)" screen of the dedicated software, the total count number of a control mode is set to 50,000 particles, the number of measurement times is set to 1, and a value obtained by using "standard particles having a particle diameter of 10.0 μm" (manufactured by Beckman Coulter, Inc) is set as a Kd value.

A threshold and a noise level are automatically set by pressing a "threshold/noise level measurement" button. In addition, a current is set to 1,600 μA, a gain is set to 2, and an electrolyte solution is set to an ISOTON II, and a check mark is placed in a check box as to whether the aperture tube is flushed after the measurement.

In the "setting for conversion from pulse to particle diameter" screen of the dedicated software, a bin interval is set to a logarithmic particle diameter, the number of particle diameter bins is set to 256, and a particle diameter range is set to be 2 μm to 60 μm.

A specific measurement method is as described below.

(i) About 200 ml of the electrolyte solution is placed into a 250-ml round-bottom beaker made of glass dedicated for the Multisizer 3. The beaker is set in a sample stand, and the electrolyte solution in the beaker is stirred with a stirrer rod at 24 rotations/sec in a counterclockwise direction. Then, dirt and bubbles in the aperture tube are removed by the "aperture flush" function of the analysis software.

(ii) About 30 ml of the electrolyte solution is placed into a 100-ml flat-bottom beaker made of glass. About 0.3 ml of a diluted solution prepared by diluting a "Contaminon N" (a 10 mass % aqueous solution of a neutral detergent for cleaning a precision measuring device, composed of a nonionic surfactant, an anionic surfactant and an organic builder and having pH 7, manufactured by Wako Pure Chemical Industries, Ltd.) with ion-exchange water by three mass fold is added as a dispersant to the electrolyte solution.

(iii) An ultrasonic dispersing unit "Ultrasonic Dispersion System Tetora 150" (manufactured by Nikkaki Bios Co., Ltd.) in which two oscillators having an oscillatory frequency of 50 kHz are built so as to be out of phase by 180° and which has an electrical power of 120 W is prepared. A predetermined amount of ion-exchange water is placed into a water tank of the ultrasonic dispersing unit. About 2 ml of the Contaminon N is placed into the water tank.

(iv) The beaker in the section (ii) is set in the beaker fixing hole of the ultrasonic dispersing unit, and the ultrasonic dispersing unit is operated. Then, the height position of the beaker is adjusted so that the resonance state of the liquid level of the electrolyte solution in the beaker becomes maximal.

(v) About 10 mg of toner are added little by little to and dispersed in the electrolyte solution in the beaker in the section (iv) in a state in which the electrolyte solution is irradiated with the ultrasonic wave. Then, the ultrasonic dispersion treatment is continued for additional 60 seconds. The temperature of water in the water tank is appropriately adjusted so as to be 10° C. or higher and 40° C. or lower in ultrasonic dispersion.

(vi) The electrolyte solution in the section (v) in which the toner has been dispersed is dropped with a pipette, to the round-bottom beaker in the section (i) placed in the sample stand, and the concentration of the toner to be measured is adjusted to about 5%. Then, measurement is performed until the particle diameters of 50,000 particles are measured.

(vii) The measurement data is analyzed with the dedicated software attached to the apparatus, and the weight average particle diameter (D4) and number average particle diameter (D1) of the toner are calculated. An "average diameter" on the "analysis/volume statistics (arithmetic average)" screen of the dedicated software when the dedicated software is set to show a graph in a vol % unit is the weight average particle diameter (D4), and an "average diameter" on the "analysis/number statistics (arithmetic average)" screen of the dedicated software when the dedicated software is set to show a graph in a number % unit is the number average particle diameter (D1).

(4) Measurement of Average Circularity of Toner

The average circularity of toner is measured with a flow-type particle image measuring apparatus "FPIA-2100" (manufactured by SYSMEX CORPORATION). Details about the measurement are as described below.

First, the circularity of each particle of the toner is calculated from the following equation.

Circularity=(circumferential length of a circle having the same area as a particle projected area)/(circumferential length of a particle projected image)

The term "particle projected area" refers to the area of a binarized particle image, and the term "circumferential length of a particle projected image" refers to the length of a borderline obtained by connecting the edge points of the particle image. The measurement involves the use of the circumferential length of a particle image that has been subjected to image processing at an image processing resolution of 512×512 (pixel measuring 0.3 μm×0.3 μm).

The circularity is an indicator of the degree of surface unevenness of a particle. The circularity is 1.00 when the particle is of a completely spherical shape. The more complicated the surface shape of the particle, the lower the circularity is.

In addition, an average circularity C meaning the average of the circularity frequency distribution of the particles of the toner is calculated from the following equation where a circularity at a divisional section i in the grain size distribution of the particles is represented by ci and the number of measured particles is represented by m.

Average circularity $$C = \sum_{i=1}^{m} ci/m$$

A specific measurement method is as described below. 10 ml of ion-exchange water from which an impurity solid and the like have been removed in advance are prepared in a container. A surfactant, which is preferably sodium dodecylbenzenesulfonate, is added as a dispersant to ion-exchange water, and then 0.02 g of a measurement sample is added to, and dispersed in, the mixture. The dispersion treatment is performed for 2 minutes with an ultrasonic dispersing unit "Ultrasonic Dispersion System Tetora 150" (manufactured by Nikkaki Bios Co., Ltd.) in which two oscillators having an oscillatory frequency of 50 kHz are built so as to be out of phase by 180° and which has an electrical power of 120 W, whereby a dispersion liquid for measurement is obtained. At that time, the dispersion liquid is appropriately cooled so as not to have a temperature of 40° C. or higher. In addition, in order that a variation in circularity may be suppressed, the temperature of an environment in which the flow-type particle image analyzer FPIA-2100 is placed is controlled at 23° C.±0.5° C. so that the temperature in the analyzer is in the range from 26 to 27° C. Automatic focusing is performed by using a 2-μm latex particle at a predetermined time interval, or preferably at an interval of 2 hours.

The circularities of the toner particles are measured with the flow-type particle image measuring apparatus while the concentration of the dispersion liquid is readjusted so that a toner particle concentration at the time of the measurement becomes about 5,000 particles/μl. After the measurement, the average circularity of the toner is determined by using the data while data on particles having a circle-equivalent diameter of less than 2 μm is discarded. It should be noted that the circle-equivalent diameter is a value calculated as described below.

$$\text{Circle-equivalent diameter}=(\text{particle projected area}/\pi)^{1/2}\times 2$$

The measuring apparatus "FPIA-2100" used in the present invention is an apparatus in which sheath flow is made thinner (7 μm→4 μm), the magnification of a processed particle image is improved, the processing resolution of a captured image is increased (256×256→512×512), and the accuracy of the shape measurement of toner is improved as compared with an apparatus "FPIA-1000" which has been conventionally used for observing the shape of toner.

(5) Method of Testing Wettability to Water/Methanol

In the present invention, the wettability, i.e., the hydrophobic characteristic of toner is determined from a methanol dropping transmittance curve obtained as described below.

First, 70 ml of a water-containing methanol liquid composed of 60 vol % of methanol and 40 vol % of water are placed into a cylindrical glass container having a diameter of 5 cm and a thickness of 1.75 mm, and the liquid is subjected to dispersion with an ultrasonic dispersing unit for 5 minutes so that bubbles and the like in a sample to be measured can be removed.

Next, the toner is screened with a mesh having an aperture of 150 μm. 0.1 g of the toner which has passed through the mesh is precisely weighed, and is added to the container containing the above water-containing methanol liquid, whereby a sample liquid for measurement is prepared.

Then, the sample liquid for measurement is set in a powder wettability tester "WET-100P" (manufactured by RHESCA). The sample liquid for measurement is stirred with a magnetic stirrer at a speed of 6.7 $s^{-1}$ (400 rpm). A spindle rotor coated with a fluorine resin, having a length of 25 mm and a maximum middle diameter of 8 mm, is used as the rotor of the magnetic stirrer.

Next, the methanol dropping transmittance curve is prepared by measuring the transmittance of light having a wavelength of 780 nm through the sample liquid for measurement while continuously adding methanol through the above apparatus at a dropping rate of 1.3 ml/min.

(6) Method of Measuring Extraction of Magnetic Substance

The amount of a magnetic substance dispersed and dissolved in 5-mol/l hydrochloric acid is measured as described below.

(1) 25 mg of toner (fro four times) are precisely weighed.

(2) Each toner sample is placed into a sample bottle, and 100 ml of 5-mol/l hydrochloric acid is added to the bottle; four samples are prepared by the same operation. The toner is dissolved in hydrochloric acid while each sample is stirred with a stirrer for 3 minutes, 15 minutes, 30 minutes, or overnight.

(3) Each solution after the dissolution is filtrated through a sample treatment filter (having a pore size of 0.2 to 0.5 μm, for example, Maishori Disk H-25-2 (manufactured by TOSOH CORPORATION) can be used) After that, the absorbance of the filtrate at a wavelength of 338 nm is measured with a spectrophotometer (such as UV-3100PC manufactured by Shimadzu Corporation). In addition, at that time, 10-mol/l hydrochloric acid in which no toner has been dispersed is placed into a reference cell. The "absorbance" in the present invention is represented by a common logarithm of a reciprocal of a transmittance $I/I_0$ as a ratio of an intensity I of transmitted light to an intensity $I_0$ of incident light when light is incident on a sample cell, i.e., by $\log(I_0/I)$.

Measurement conditions: scanning speed (medium speed), slit width (0.5 nm), sampling pitch (2 nm), measurement range (250 nm or more and 600 nm or less)

In the present invention, the amount of the magnetic substance dissolved at each of 3 minutes and 15 minutes with respect to the total content of the magnetic substance are calculated from ratio of the absorbance of the solution taken out at each of 3 minutes and 15 minutes to the absorbance of the solution having been left standing overnight (the magnetic substance is completely dissolved).

(7) Method of Measuring Cohesion Degree of Toner

The cohesion degree of toner was measured as described below.

A measuring apparatus used was such that a digital display vibration meter "DIGIVIBLO MODEL 1332A" (manufactured by Showa Sokki Corporation) was connected to a side surface portion of a vibrating table of a "Powder Tester" (manufactured by Hosokawa Micron Corporation). Then, a sieve having an aperture of 38 μm (400 meshes), a sieve having an aperture of 75 μm (200 meshes), and a sieve having an aperture of 150 μm (100 meshes) were superimposed and set in the stated order from below on the vibrating table of the Powder Tester. Measurement was performed in a 23° C. and 60% RH environment as described below.

(i) The amplitude of the vibrating table was previously adjusted so that the displacement of the digital display vibration meter was 0.60 mm (peak-to-peak).

(ii) 5 g of the toner previously left standing under the 23° C. and 60% RH environment for 24 hours were precisely weighed and gently placed on the sieve having an aperture of 150 μm at the uppermost stage.

(iii) The sieves were vibrated for 15 seconds. After that, the mass of the toner remaining on each sieve was measured, and the cohesion degree was calculated on the basis of the following equation.

$$\text{Cohesion degree (\%)}=\{(\text{mass (g) of sample on sieve having aperture of 150 μm})/5\text{ (g)}\}\times 100+\{(\text{mass (g) of sample on sieve having aperture of 75 μm})/5\text{ (g)}\}\times 100\times 0.6+\{(\text{mass (g) of sample on sieve having aperture of 38 μm})/5\text{ (g)}\}\times 100\times 0.2$$

EXAMPLES

Hereinafter, the present invention will be described specifically by way of production examples and examples. However, the present invention is not limited to them. The term "part(s)" in the following formulation means "part(s) by mass" with no exception.

Magnetic Iron Oxide Production Example 1

An aqueous solution of ferrous sulfate was mixed with a caustic soda solution in an amount of 1.0 to 1.1 equivalents with respect to iron ions (the solution contained sodium hexametaphosphate in a content of 1 mass % in terms of phosphorus with respect to Fe), whereby an aqueous solution containing ferrous hydroxide was prepared. While the aqueous solution was maintained at pH 9, air was blown into the aqueous solution so that oxidation reaction was performed at 80 to 90° C., whereby a slurry liquid for producing seed crystals was prepared.

Next, the aqueous solution of ferrous sulfate in an amount of 0.9 to 1.2 equivalents with respect to the initial alkali amount (sodium component of caustic soda) was added to the slurry liquid. After that, oxidation reaction was advanced by blowing air into the slurry liquid while maintaining the slurry liquid at pH 8. The pH was adjusted to about 6 at the end of oxidation reaction. Then, n-$C_4H_9Si(OCH_3)_3$ and n-$C_8H_{17}Si(OC_2H_5)_3$ as silane coupling agents were added to the resultant respectively in amounts of 0.9 part and 0.6 part with respect to 100 parts of magnetic iron oxide, and the mixture was sufficiently stirred. The produced hydrophobic iron oxide particles were washed, filtrated, and dried by ordinary methods. Next, cohesion particles were disintegrated, whereby a magnetic iron oxide 1 was obtained.

The magnetic iron oxide 1 had an average particle diameter of 0.24 μm, and a saturation magnetization of 68.6 $\mu m^2/kg$ (emu/g) and a residual magnetization of 3.4 $\mu m^2/kg$ (emu/g) in a magnetic field of 79.6 kA/m (1,000 Oe).

Magnetic Iron Oxide Production Examples 2 to 4

Magnetic iron oxides 2 to 4 shown in Table 6 were obtained in the same manner as described above except that the magnetic properties of magnetic iron oxide, and the types and amounts of treatment agents were changed as shown in Table 6.

Magnetic Iron Oxide Production Examples 5 and 6

Magnetic iron oxides 5 and 6 shown in Table 6 were obtained in the same manners as in Magnetic Iron Oxide Production Examples 1 and 4, respectively, except that surface treatment with a silane coupling agent was not performed.

TABLE 6

| | Number | Magnetic characteristics | | | |
|---|---|---|---|---|---|
| | average particle diameter (μm) | Saturation magnetization ($Am^2/kg$) | Residual magnetization ($Am^2/kg$) | Coupling agent Type | Coupling agent Part(s) added |
| Magnetic iron oxide 1 | 0.24 | 68.6 | 3.4 | Treatment agent 1/ Treatment agent 3 | 0.9/0.6 |
| Magnetic iron oxide 2 | 0.20 | 69.5 | 4.5 | Treatment agent 2/ Treatment agent 3 | 0.5/1.5 |
| Magnetic iron oxide 3 | 0.26 | 68.5 | 6.3 | Treatment agent 2/ Treatment agent 3 | 0.9/0.6 |
| Magnetic iron oxide 4 | 0.26 | 67.3 | 4.0 | Treatment agent 2 | 0.5 |
| Magnetic iron oxide 5 | 0.25 | 68.3 | 3.5 | — | — |
| Magnetic iron oxide 6 | 0.29 | 68.6 | 6.5 | — | — |

Treatment agent 1: n-$C_4H_9Si(OCH_3)_3$
Treatment agent 2: n-$C_6H_{13}Si(OCH_3)_3$
Treatment agent 3: n-$C_8H_{17}Si(OC_2H_5)_3$ <Production of Magnetic Toner A>

451 parts of a 0.1-mol/l aqueous solution of were placed into 709 parts of ion-exchange water, and was heated to 60° C. After that, 67.7 parts of a 1.0-mol/l aqueous solution of $CaCl_2$ were gradually added to the mixture, whereby an aqueous medium containing $Ca_3(PO_4)_2$ was obtained.

The following formulation was uniformly dispersed and mixed by using an Attritor (manufactured by Mitsui Miike Machinery Co., Ltd.).

| | |
|---|---|
| Styrene | 76 parts |
| n-butyl acrylate | 24 parts |
| Saturated polyester resin (Monomer constitution: propylene oxide adduct of bisphenol A/terephthalic acid; acid value: 12 mgKOH/g; Tg = 72° C.; Mn = 3,900; Mw = 10,000) | 4 parts |
| Negative charge control agent (T-77 (monoazo dye-type Fe compound) (manufactured by Hodogaya Chemical Co., Ltd.)) | 2 parts |
| Magnetic iron oxide 1 | 85 parts |

The monomer composition was heated to 60° C., and 10 parts of HNP-9 manufactured by Nippon Seiro Co., Ltd. (polyethylene wax, DSC endothermic main peak=78° C.) were mixed and dissolved in the composition. 6 parts of dibenzoyl peroxide as a polymerization initiator were dissolved in the resultant, whereby a polymerizable monomer system was obtained.

The above polymerizable monomer system was placed into the aqueous medium, and stirred under an $N_2$ atmosphere at 60° C. by using CLEAR MIX (manufactured by MTECHNIQUE Co., Ltd.) at 12,000 rpm for 15 minutes so as to be granulated. After that, the resultant was allowed to react at 75° C. for 1 hour while being stirred with a paddle stirring blade. Thereafter, the stirring was continued for additional 6 hours. After the completion of the polymerization reaction, heating was stopped, and 75 parts by mass of saturated vapor (steam pressure 205 kPa; temperature 120° C.) per hour was directly introduced into the resultant content. The temperature of the content in the container reached 100° C. 10 minutes after the initiation of the introduction of the saturated vapor. 3 hours after the temperature in the container for polymerization reached 100° C., the suspension was cooled, and hydrochloric acid was added to the suspension to dissolve $Ca_3(PO_4)_2$. Then, the resultant was filtrated, washed with water, and dried. The powder was classified with an pneumatic classifier, whereby magnetic toner particles were obtained.

100 parts of the magnetic toner particles, 1.0 part of a hydrophobic silica fine powder having a BET specific surface area of 160 $m^2/g$ after treatment with hexamethyldisilazane and then with silicone oil, 0.5 part of an external additive 2 shown in Table 7, and 0.2 part of an external additive 4 shown in Table 7 were mixed by using a Henschel mixer (manufactured by Mitsui Miike Machinery Co., Ltd.), thereby preparing Magnetic Toner A. Table 9 shows the physical properties of Magnetic Toner A.

<Production of Magnetic Toners B and C>

Magnetic Toners B and C were obtained in the same manner as in the production example of Magnetic Toner A except that the time period for which vapor was introduced into the reaction system after the reaction of the polymerizable monomer system was changed to 1 hour and 5 hours, respectively. Table 9 shows the physical properties of Magnetic Toners B and C.

<Production of Magnetic Toners D to F>

Magnetic Toners D to F were obtained in the same manner as in the production example of Magnetic Toner A except that: the magnetic substance and the external additive were changed as shown in Table 8; and classification conditions were adjusted so that the weight average particle diameter (D4) and the ratio of the weight average particle diameter (D4) to the number average particle diameter (D1) were changed. Table 9 shows the physical properties of Magnetic Toners D to F.

<Production of Magnetic Toners G to I>

Magnetic Toners G to I were obtained in the same manner as in the production example of Magnetic Toner A except that the type of inorganic or organic fine powder to be added to magnetic toner particles was changed as shown in Table 8. Table 9 shows the physical properties of Magnetic Toners G to I.

<Production of Magnetic Toner J>

Magnetic Toner J was obtained in the same manner as in the production example of Magnetic Toner A except that the type of magnetic substance to be used was changed as shown in Table 8. Table 9 shows the physical properties of Magnetic Toner J.

<Production of Magnetic Toners K and L>

Magnetic Toners K and L were obtained in the same manner as in the production example of Magnetic Toner A except that: the amount of $Ca_3(PO_4)_2$ to be added was adjusted; and the toner particle diameter was changed. Table 9 shows the physical properties of Magnetic Toners K and L.

<Production of Magnetic Toners a to f for Comparison>

Magnetic Toners a to f were obtained in the same manner as in the production example of Magnetic Toner A except that: the magnetic iron oxide and the external additive were changed as shown in Table 8; and the toner particle diameter was changed. Table 9 shows the physical properties of Magnetic Toners a to f.

TABLE 7

| External additive No | Type of material | Number average particle diameter |
|---|---|---|
| External additive 1 | Sol-gel silica treated with hexamethyldisilazane | 100 nm |
| External additive 2 | Strontium titanate treated with stearate | 120 nm |
| External additive 3 | Strontium titanate | 0.8 μm |
| External additive 4 | PMMA particles | 1.0 μm |
| External additive 5 | Rutile-type titanium oxide | 100 nm |

TABLE 8

| | | Magnetic substance No | | Inorganic or organic fine powder added to toner base body | | | | | |
|---|---|---|---|---|---|---|---|---|---|
| Toner No | Manufacturing method | Type | Addition amount | Type (1) | Addition amount | Type (2) | Addition amount | Type (3) | Addition amount |
| Magnetic toner A | Suspension polymerization | Magnetic iron oxide 1 | 80 | Hydrophobic treatment silica | 1.0 | External additive 2 | 0.5 | External additive 4 | 0.2 |
| Magnetic toner B | Suspension polymerization | Magnetic iron oxide 1 | 80 | Hydrophobic treatment silica | 1.0 | External additive 2 | 0.5 | External additive 4 | 0.2 |
| Magnetic toner C | Suspension polymerization | Magnetic iron oxide 1 | 80 | Hydrophobic treatment silica | 1.0 | External additive 2 | 0.5 | External additive 4 | 0.2 |
| Magnetic toner D | Suspension polymerization | Magnetic iron oxide 2 | 95 | Hydrophobic treatment silica | 1.5 | External additive 3 | 0.5 | External additive 4 | 0.2 |
| Magnetic toner E | Suspension polymerization | Magnetic iron oxide 2 | 95 | Hydrophobic treatment silica | 1.5 | External additive 3 | 0.5 | External additive 4 | 0.2 |
| Magnetic toner F | Suspension polymerization | Magnetic iron oxide 2 | 95 | Hydrophobic treatment silica | 1.5 | External additive 3 | 0.5 | External additive 4 | 0.2 |
| Magnetic toner G | Suspension polymerization | Magnetic iron oxide 1 | 85 | Hydrophobic treatment silica | 1.0 | External additive 2 | 0.3 | External additive 1 | 0.2 |
| Magnetic toner H | Suspension polymerization | Magnetic iron oxide 1 | 85 | Hydrophobic treatment silica | 1.0 | External additive 2 | 0.3 | External additive 3 | 0.5 |
| Magnetic toner I | Suspension polymerization | Magnetic iron oxide 1 | 85 | Hydrophobic treatment silica | 1.0 | External additive 2 | 0.3 | External additive 5 | 0.1 |
| Magnetic toner J | Suspension polymerization | Magnetic iron oxide 3 | 95 | Hydrophobic treatment silica | 1.0 | External additive 2 | 0.5 | External additive 4 | 0.2 |
| Magnetic toner K | Suspension polymerization | Magnetic iron oxide 1 | 85 | Hydrophobic treatment silica | 0.5 | External additive 2 | 0.2 | External additive 4 | 0.1 |
| Magnetic toner L | Suspension polymerization | Magnetic iron oxide 1 | 85 | Hydrophobic treatment silica | 1.5 | External additive 2 | 1.0 | External additive 4 | 0.3 |
| Magnetic toner a | Suspension polymerization | Magnetic iron oxide 4 | 95 | Hydrophobic treatment silica | 1.0 | External additive 2 | 0.5 | — | — |
| Magnetic toner b | Suspension polymerization | Magnetic iron oxide 3 | 95 | Hydrophobic treatment silica | 1.0 | External additive 2 | 0.5 | — | — |
| Magnetic toner c | Suspension polymerization | Magnetic iron oxide 4 | 95 | Hydrophobic treatment silica | 1.0 | External additive 3 | 0.5 | — | — |
| Magnetic toner d | Suspension polymerization | Magnetic iron oxide 3 | 95 | Hydrophobic treatment silica | 1.0 | External additive 2 | 0.5 | External additive 4 | 0.2 |
| Magnetic toner e | Suspension polymerization | Magnetic iron oxide 4 | 95 | Hydrophobic treatment silica | 1.0 | — | — | — | — |
| Magnetic toner f | Suspension polymerization | Magnetic iron oxide 3 | 95 | Hydrophobic treatment silica | 1.0 | — | — | — | — |

TABLE 9

| Toner No | Toner particle diameter: Weight average particle diameter | Toner particle diameter: Weight average particle diameter/number average particle diameter | Average circularity | Compressibilitsy | Total Energy measured with powder flowability measuring apparatus: TE10 | Total Energy measured with powder flowability measuring apparatus: TE10/TE100 | Residual magnetization of magnetic toner | Amount of magnetic substance dissolution when dissolving in HCl of 5 mol/l: S3 | Amount of magnetic substance dissolution when dissolving in HCl of 5 mol/l: S15 | Cohesion degree |
|---|---|---|---|---|---|---|---|---|---|---|
| Magnetic toner A | 7.5 | 1.13 | 0.971 | 26 | 1,200 | 1.43 | 1.4 | 3 | 62 | 18 |
| Magnetic toner B | 7.4 | 1.14 | 0.964 | 23 | 1,400 | 1.52 | 1.4 | 4 | 63 | 20 |
| Magnetic toner C | 7.6 | 1.12 | 0.975 | 28 | 900 | 1.20 | 1.4 | 2 | 61 | 14 |
| Magnetic toner D | 7.0 | 1.19 | 0.970 | 23 | 1,100 | 1.38 | 2.4 | 7 | 48 | 13 |
| Magnetic toner E | 6.8 | 1.16 | 0.972 | 27 | 1,200 | 1.33 | 2.4 | 6 | 46 | 10 |
| Magnetic toner F | 6.6 | 1.11 | 0.973 | 29 | 1,500 | 1.30 | 2.4 | 8 | 50 | 9 |
| Magnetic toner G | 7.3 | 1.14 | 0.969 | 22 | 1,300 | 1.39 | 1.8 | 2 | 60 | 15 |
| Magnetic toner H | 7.2 | 1.15 | 0.970 | 28 | 1,500 | 1.58 | 1.8 | 4 | 63 | 25 |
| Magnetic toner I | 7.4 | 1.13 | 0.972 | 26 | 900 | 1.56 | 1.8 | 3 | 61 | 6 |
| Magnetic toner J | 7.2 | 1.12 | 0.974 | 27 | 1,300 | 1.47 | 3.2 | 2 | 58 | 17 |
| Magnetic toner K | 8.5 | 1.17 | 0.958 | 19 | 1,200 | 1.43 | 1.6 | 3 | 60 | 10 |
| Magnetic toner L | 5.7 | 1.12 | 0.974 | 29 | 1,500 | 1.55 | 1.5 | 4 | 66 | 18 |
| Magnetic toner a | 7.3 | 1.14 | 0.952 | 34 | 1,500 | 1.75 | 1.8 | 12 | 83 | 14 |
| Magnetic toner b | 7.4 | 1.15 | 0.953 | 33 | 1,600 | 1.68 | 3.8 | 2 | 59 | 13 |
| Magnetic toner c | 7.8 | 1.23 | 0.951 | 27 | 1,900 | 1.90 | 2.0 | 13 | 80 | 11 |
| Magnetic toner d | 7.9 | 1.25 | 0.950 | 28 | 2,000 | 1.71 | 3.9 | 3 | 57 | 19 |
| Magnetic toner e | 7.6 | 1.26 | 0.968 | 25 | 1,400 | 1.73 | 2.3 | 10 | 78 | 8 |
| Magnetic toner f | 7.2 | 1.15 | 0.970 | 26 | 1,200 | 1.64 | 3.8 | 4 | 55 | 9 |

<Production of Developing Device for Evaluation>

A cartridge of a laser beam printer LBP-3000 (manufactured by Canon Inc.) was remodeled so that the diameter of a developing sleeve of a developing device and the magnetic flux density of the developing sleeve at a developing pole were as shown in Table 10. Thus, cartridges 1 to 5 were produced.

[Method of Producing Toner Bearing Member]

A coating liquid for a resin coat layer to be formed on the surface of the developing sleeve was produced according to the following compounding ratio.

| | |
|---|---|
| Resol type phenol resin (using an ammonia catalyst, containing 40% of methanol, manufactured by Dainippon Ink and Chemicals, Incorporated, trade name: J325) | 350 parts |
| Crystalline graphite (volume average particle diameter: 5.5 μm) | 90 parts |
| Conductive carbon black (manufactured by Columbia Carbon, trade name: Conductex 975) | 10 parts |
| Conductive spherical particles (manufactured by Nippon Carbon Co., Ltd., trade name: NICABEADS PC1020) | 30 parts |
| Isopropyl alcohol | 300 parts |

The above materials were dispersed with a sand mill using glass beads. A method for the dispersion was as follows: the above conductive carbon black, the above crystalline graphite described above and 100 parts of isopropyl alcohol were added to a solution of the above resol type phenol resin, and was dispersed with the sand mill using glass beads having a diameter of 1 mm as media particles for 2 hours. Further, remaining isopropyl alcohol and the above conductive spherical particles were added to the resultant, and dispersed with the sand mill for 30 minutes, whereby the coating liquid was obtained.

A conductive coat layer was formed from the above coating liquid on a cylindrical tube made of aluminum having an outer diameter of 8 mm, 10 mm or 14 mm by a spray method. Subsequently, the conductive coat layer was heated and cured in a hot-air drying furnace at 160° C. for 30 minutes, whereby a developer bearing member a was produced. A surface roughness (arithmetic-mean roughness) Ra of the member measured at that time was 1.52 μm.

TABLE 10

| Development device No for evaluation | Outer diameter of development sleeve | Flux density at development pole |
|---|---|---|
| Cartridge 1 | 10 mm | 650 G |
| Cartridge 2 | 10 mm | 850 G |
| Cartridge 3 | 8 mm | 650 G |
| Cartridge 4 | 8 mm | 550 G |
| Cartridge 5 | 14 mm | 850 G |

Example 1

The following evaluation was performed by using a commercially available laser beam printer LBP-3000 on which the cartridge 1 shown in Table 10 filled with Magnetic Toner A was mounted. A 1500-sheet durability test was performed under each of a normal-temperature, normal-humidity environment (having a temperature of 23° C. and a humidity of 50%) and a high-temperature, high-humidity environment (having a temperature of 30° C. and a humidity of 80%). A chart having an image ratio of 5% was used as an original. Evaluation was made for image density and image quality (fogging, tailing, and transfer void) before and after the durability test according to the following criteria.

(Image Evaluation)

1. Image Density

A solid image portion was formed on the entire surface of printing paper at the initial stage and after forming images on 1,500 sheets, and the density of the solid image was measured with a Macbeth Densitometer (manufactured by Macbeth Co.) using an SPI filter.

2. Fogging

The reflectivity of the white portion of the above image and the reflectivity of unused paper were measured with a reflectivity measuring machine for measuring fogging "REFLECTOMETER" (manufactured by Tokyo Denshoku CO., LTD.), and the difference between the reflectivities was defined as fogging.

Fogging (%)=reflectivity of unused paper−reflectivity of white portion of image after the durability test A: The fogging is less than 0.3%.

B: The fogging is 0.3% or more and less than 1.0%.

C: The fogging is 1.0% or more and less than 2.0%.

D: The fogging is 2.0% or more and less than 2.5%.

E: The fogging is 2.5% or more.

3. Tailing

Evaluation for tailing was performed as described below. At the initial stage and after forming images on 1,500 sheets, the machine (developing device) was stopped during development of an image pattern having an image area ratio of about 3% and composed only of horizontal lines, and a situation in which tailing occurred at a character portion on a photosensitive drum after the development was judged by visual observation in accordance with the following criteria.

A: No tailing occurs.

B: Tailing slightly occurs, but the resultant image is good.

C: Tailing occurs, but the resultant image has quality raising no problem in practical use.

D: Tailing occurs remarkably.

4. Void

Evaluation for void was performed as described below. At the initial stage and after forming images on 1,500 sheets, an image including a line and a character was printed out, and was evaluated by visual observation or with a magnifying microscope on the basis of the following criteria.

A: Even details of both the character image and the line image are faithfully reproduced.

B: The details of the resultant image undergo disturbances or voids to some extent, but the image is at such a level as to have no problems in visual observation.

C: The resultant image is at such a level that disturbances or voids can be detected by visual observation.

D: Many disturbances and voids occur, and the resultant image does not reproduce an original.

As a result, good results were obtained as shown in Table 12.

Examples 2 to 15

In Examples 2 to 15, evaluation was performed in the same manner as in Example 1 except that such combinations as shown in Table 11 were used. As a result, good results were obtained as shown in Table 12.

Comparative Examples 1 to 8

In Comparative Examples 1 to 8, evaluation was performed in the same manner as in Example 1 except that such combinations as shown in Table 11 were used. As a result, the results as shown in Table 12 were obtained.

TABLE 11

| | Toner No | Developing device for evaluation |
|---|---|---|
| Example 1 | Magnetic toner A | Cartridge 1 |
| Example 2 | Magnetic toner B | Cartridge 1 |
| Example 3 | Magnetic toner C | Cartridge 1 |
| Example 4 | Magnetic toner D | Cartridge 1 |
| Example 5 | Magnetic toner E | Cartridge 1 |
| Example 6 | Magnetic toner F | Cartridge 1 |
| Example 7 | Magnetic toner G | Cartridge 1 |
| Example 8 | Magnetic toner H | Cartridge 1 |
| Example 9 | Magnetic toner I | Cartridge 1 |
| Example 10 | Magnetic toner J | Cartridge 1 |
| Example 11 | Magnetic toner K | Cartridge 1 |
| Example 12 | Magnetic toner L | Cartridge 1 |
| Example 13 | Magnetic toner C | Cartridge 2 |
| Example 14 | Magnetic toner C | Cartridge 3 |
| Example 15 | Magnetic toner C | Cartridge 4 |
| Comparative Example 1 | Magnetic toner a | Cartridge 1 |
| Comparative Example 2 | Magnetic toner b | Cartridge 1 |
| Comparative Example 3 | Magnetic toner c | Cartridge 1 |
| Comparative Example 4 | Magnetic toner d | Cartridge 1 |
| Comparative Example 5 | Magnetic toner e | Cartridge 1 |
| Comparative Example 6 | Magnetic toner f | Cartridge 1 |
| Comparative Example 7 | Magnetic toner a | Cartridge 3 |
| Comparative Example 8 | Magnetic toner a | Cartridge 5 |

TABLE 12

| | Evaluation results for developability in extensive operation | | | | | | | |
|---|---|---|---|---|---|---|---|---|
| | Image density | | Fogging | | Tailing | | Void | |
| | Initial stage | After 1,500 sheets | Initial stage | After 1,500 sheets | Initial stage | After 1,500 sheets | Initial stage | After 1,500 sheets |
| Example 1 | 1.45 | 1.43 | A | B | A | B | A | A |
| Example 2 | 1.43 | 1.39 | A | C | A | B | A | B |
| Example 3 | 1.47 | 1.46 | A | B | A | A | A | A |
| Example 4 | 1.40 | 1.35 | B | C | B | C | B | C |
| Example 5 | 1.42 | 1.39 | B | C | B | B | B | C |
| Example 6 | 1.45 | 1.43 | B | B | A | B | A | B |
| Example 7 | 1.45 | 1.44 | B | B | A | A | A | A |
| Example 8 | 1.43 | 1.39 | B | C | B | C | B | B |
| Example 9 | 1.39 | 1.36 | A | B | A | B | A | C |
| Example 10 | 1.42 | 1.34 | A | B | B | C | B | C |
| Example 11 | 1.44 | 1.38 | A | A | A | B | B | C |
| Example 12 | 1.42 | 1.35 | B | C | B | B | A | B |
| Example 13 | 1.40 | 1.34 | A | A | A | B | B | B |
| Example 14 | 1.44 | 1.36 | B | C | A | B | B | B |
| Example 15 | 1.45 | 1.40 | C | C | A | B | A | B |
| Comparative Example 1 | 1.43 | 1.27 | B | D | B | C | B | C |
| Comparative Example 2 | 1.42 | 1.19 | A | C | B | D | B | D |
| Comparative Example 3 | 1.37 | 1.13 | C | D | C | D | C | D |
| Comparative Example 4 | 1.36 | 1.09 | B | D | C | D | C | D |
| Comparative Example 5 | 1.41 | 1.29 | C | D | B | D | B | C |
| Comparative Example 6 | 1.40 | 1.26 | A | C | B | D | B | D |
| Comparative Example 7 | 1.38 | 1.02 | C | D | C | D | C | D |
| Comparative Example 8 | 1.44 | 1.33 | A | B | A | B | B | C |

<Production of Magnetic Toner M>
(Production Example of Binder Resin)

| | |
|---|---|
| Terephthalic acid | 27 mol % |
| Adipic acid | 15 mol % |
| Trimellitic acid | 6 mol % |
| Bisphenol derivative represented by the formula (I) (Adduct of 2.5 mol of propylene oxide) | 35 mol % |
| Bisphenol derivative represented by the formula (I) (Adduct of 2.5 mol of ethylene oxide) | 17 mol % |

The above polyester monomers and an esterification catalyst were placed into a four-necked flask. The flask was provided with a decompression apparatus, a water-separating apparatus, a nitrogen gas-introducing apparatus, a temperature-measuring apparatus, and a stirring apparatus. Then, the temperature of the mixture in the flask was raised to 230° C. in a nitrogen atmosphere to effect reaction. After completion of the reaction, the product was taken out of the container, and was cooled and pulverized, whereby a resin A having a softening point of 143° C. was obtained.

| | |
|---|---|
| Terephthalic acid | 24 mol % |
| Adipic acid | 16 mol % |
| Trimellitic acid | 10 mol % |
| Bisphenol derivative represented by the formula (I) (Adduct of 2.5 mol of propylene oxide) | 30 mol % |
| Bisphenol derivative represented by the formula (I) (Adduct of 2.5 mol of ethylene oxide) | 20 mol % |

The above polyester monomers and an esterification catalyst were placed into a four-necked flask. The flask was provided with a decompression apparatus, a water-separating apparatus, a nitrogen gas-introducing apparatus, a temperature-measuring apparatus, and a stirring apparatus. Then, the temperature of the mixture in the flask was raised to 230° C. under a nitrogen atmosphere to effect reaction. After completion of the reaction, the product was taken out of the container, and was cooled and pulverized, whereby a resin B having a softening point of 98° C. was obtained.

50 parts of the resin A and 50 parts of the resin B were mixed by using a Henschel mixer, whereby a binder resin 1 was obtained.

The binder resin 1 had a glass transition temperature of 59° C. and a softening point of 128° C., and contained 43% of a component having a molecular weight of 10,000 or less in gel permeation chromatography.

| | |
|---|---|
| Binder resin 1 | 100 parts |
| Magnetic substance 1 | 95 parts |
| Monoazo iron complex (T-77: manufactured by Hodogaya Chemical Co., Ltd.) | 2 parts |
| Polyethylene wax (having a melting point of 105° C.) (C105 manufactured by Sasol) | 4 parts |

The above mixture was preliminarily mixed by using a Henschel mixer. After that, the mixture was melted and kneaded with a biaxial extruder heated to 110° C. The kneaded product was cooled, and was then coarsely pulverized with a hammer mill, thereby obtaining a coarsely pulverized product of toner. The resultant coarsely pulverized product was finely pulverized by mechanical pulverization using a mechanical pulverizer Turbo mill (manufactured by Turbo Kogyo Co., Ltd.; the surface of each of a rotor and a stator was plated with a chromium alloy containing chromium carbide (plating thickness 150 μm, surface hardness HV1050)). Fine powder and coarse powder were simultaneously classified and removed from the resultant coarsely pulverized products by means of a multi-division classifying apparatus utilizing Coanda effect (Elbow Jet Classifier manufactured by Nittetsu Mining Co., Ltd.). The toner particles thus obtained had a weight average particle diameter ($D_4$) of 7.5 μm.

The raw material toner particles were subjected to surface modification by means of a Meteorainbow MR-3 model (manufactured by Nippon Pneumatic Mfg. Co., Ltd.) as an apparatus for modifying the surfaces of toner particles by blowing hot air. Conditions at the time of the surface modification were as follows: a raw material feeding rate of 2 kg/hr, a flow rate of the hot air of 700 l/min, and a discharge temperature of the hot air of 250° C.

100 parts of the magnetic toner particles, 1.0 part of a hydrophobic silica fine powder having a BET specific surface area after treatment with hexamethyldisilazane and then with silicone oil of 160 $m^2/g$, and the external additives 2 and 4 shown in Table 13 were mixed by using a Henschel mixer (manufactured by Mitsui Miike Machinery Co., Ltd.), to thereby prepare Magnetic Toner M. Table 14 shows the physical properties of Magnetic Toner M.

<Production of Magnetic Toner N>

Magnetic Toner N was obtained in the same manner as in the production example of Magnetic Toner M except that the conditions under which the surface modification was performed with the Meteorainbow MR-3 model (manufactured by Nippon Pneumatic Mfg. Co., Ltd.) were changed as follows: a raw material feeding rate of 2 kg/hr, a flow rate of the hot air of 500 l/min, and a discharge temperature of the hot air of 200° C. Table 14 shows the physical properties of Magnetic Toner N.

<Production of Magnetic Toners O and P>

Magnetic Toners O and P were obtained in the same manner as in the production example of Magnetic Toner M except that the magnetic iron oxide and the external additive were changed as shown in Table 13. Table 14 shows the physical properties of Magnetic Toners O and P.

<Production of Magnetic Toner g for Comparison>

Magnetic Toner g was obtained in the same manner as in the production example of Magnetic Toner M except that the external additive was changed as shown in Table 13. Table 14 shows the physical properties of Magnetic Toner g.

<Production of Magnetic Toners h and i for Comparison>

Magnetic Toners h and i were obtained in the same manner as in the production example of Magnetic Toner M except that: the surface modification by means of the Meteorainbow MR-3 model (manufactured by Nippon Pneumatic Mfg. Co., Ltd.) was not performed; and the magnetic substance and the external additive were changed as shown in Table 13. Table 14 shows the physical properties of Magnetic Toners h and i.

Example 15

The following evaluation was performed by using a commercially available laser beam printer LBP-3000 on which the cartridge 1 filled with Magnetic Toner A was mounted. A 1,000-sheet durability test was performed in each of a normal-temperature, normal-humidity environment (having a temperature of 23° C. and a humidity of 50%) and a high-temperature, high-humidity environment (having a temperature of 30° C. and a humidity of 80%). A chart having an image ratio of 5% was used as an original. Evaluation for image density and image quality (fogging, tailing, and transfer void) was performed before and after the durability test in the same manner as in Example 1.

Examples 16 to 19

Evaluation was performed in the same manner as in Example 15 except that such combinations as shown in Table 15 were employed. As a result, good results were obtained as shown in Table 16.

Comparative Examples 9 to 13

Evaluation was performed in the same manner as in Example 15 except that such combinations as shown in Table 15 were employed. As a result, the results as shown in Table 16 were obtained.

TABLE 13

| | | | Inorganic or organic fine powder added to toner base body | | | | | |
|---|---|---|---|---|---|---|---|---|
| Toner No. | Manufacturing method | Magnetic substance No. | Type (1) | Addition amount | Type (2) | Addition amount | Type (3) | Addition amount |
| Magnetic toner M | Pulverization method | Magnetic iron oxide 5 | Hydrophobic treatment silica | 1.0 | External additive 2 | 0.5 | External additive 4 | 0.2 |
| Magnetic toner N | Pulverization method | Magnetic iron oxide 5 | Hydrophobic treatment silica | 1.0 | External additive 2 | 0.5 | External additive 4 | 0.2 |
| Magnetic toner O | Pulverization method | Magnetic iron oxide 6 | Hydrophobic treatment silica | 1.0 | External additive 2 | 0.5 | External additive 4 | 0.2 |
| Magnetic toner P | Pulverization method | Magnetic iron oxide 5 | Hydrophobic treatment silica | 1.0 | External additive 2 | 0.5 | External additive 5 | 0.1 |
| Magnetic toner g | Pulverization method | Magnetic iron oxide 5 | Hydrophobic treatment silica | 1.0 | — | — | — | — |
| Magnetic toner h | Pulverization method | Magnetic iron oxide 6 | Hydrophobic treatment silica | 1.0 | External additive 3 | 0.5 | External additive 4 | 0.2 |
| Magnetic toner i | Pulverization method | Magnetic iron oxide 6 | Hydrophobic treatment silica | 1.0 | External additive 2 | 0.3 | — | — |

TABLE 14

| Toner No | Toner particle diameter: Weight average particle diameter | Toner particle diameter: Weight average particle diameter/number average particle diameter | Average circularity | Compressibility | Total Energy measured with powder flowability measuring apparatus: TE10 | Total Energy measured with powder flowability measuring apparatus: TE10/TE100 | Residual magnetization of magnetic toner | Wettability to a methanol/water mixed solvent | Cohesion degree |
|---|---|---|---|---|---|---|---|---|---|
| Magnetic toner M | 7.5 | 1.20 | 0.974 | 24 | 1,200 | 1.35 | 1.7 | 75 | 16 |
| Magnetic toner N | 7.3 | 1.19 | 0.963 | 29 | 1,500 | 1.57 | 1.6 | 58 | 20 |
| Magnetic toner O | 7.2 | 1.18 | 0.972 | 26 | 1,300 | 1.40 | 3.8 | 72 | 12 |
| Magnetic toner P | 7.4 | 1.20 | 0.970 | 25 | 1,300 | 1.43 | 1.9 | 74 | 5 |
| Magnetic toner g | 7.1 | 1.19 | 0.963 | 26 | 1,700 | 1.62 | 1.8 | 73 | 12 |
| Magnetic toner h | 6.9 | 1.26 | 0.937 | 32 | 1,900 | 1.95 | 3.6 | 59 | 19 |
| Magnetic toner i | 7.6 | 1.26 | 0.938 | 36 | 2,100 | 2.70 | 3.7 | 56 | 14 |

TABLE 15

| | Toner No | Cartridge No |
|---|---|---|
| Example 15 | Magnetic toner M | Cartridge 1 |
| Example 16 | Magnetic toner N | Cartridge 1 |
| Example 17 | Magnetic toner O | Cartridge 1 |
| Example 18 | Magnetic toner P | Cartridge 1 |
| Example 19 | Magnetic toner M | Cartridge 3 |
| Comparative Example 9 | Magnetic toner g | Cartridge 1 |
| Comparative Example 10 | Magnetic toner h | Cartridge 1 |
| Comparative Example 11 | Magnetic toner i | Cartridge 1 |
| Comparative Example 12 | Magnetic toner i | Cartridge 3 |
| Comparative Example 13 | Magnetic toner i | Cartridge 5 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-152221, filed Jun. 8, 2007, which is hereby incorporated by reference herein in its entirety.

What is claimed is:

1. An image-forming method comprising applying an alternating field between a latent image bearing member and a toner bearing member bearing a magnetic toner on the surface

TABLE 16

| | Evaluation results for developability in extensive operation/ Normal-temperature, normal-humidity environment: Image density: Initial stage | Image density: After 1,000 sheets | Fogging: Initial stage | Fogging: After 1,000 sheets | Tailing: Initial stage | Tailing: After 1,000 sheets | Void: Initial stage | Void: After 1,000 sheets | High-temperature, high- humidity environment: Image density: Initial stage | Image density: After 1,000 sheets |
|---|---|---|---|---|---|---|---|---|---|---|
| Example 15 | 1.45 | 1.44 | A | B | A | B | A | A | 1.43 | 1.37 |
| Example 16 | 1.43 | 1.39 | B | B | B | C | B | C | 1.38 | 1.25 |
| Example 17 | 1.42 | 1.36 | A | B | B | C | B | B | 1.40 | 1.31 |
| Example 18 | 1.42 | 1.39 | A | B | B | B | A | B | 1.38 | 1.27 |
| Example 19 | 1.41 | 1.38 | B | C | A | B | B | B | 1.39 | 1.33 |
| Comparative Example 9 | 1.43 | 1.33 | B | C | B | D | B | C | 1.38 | 1.23 |
| Comparative Example 10 | 1.36 | 1.15 | B | C | C | D | C | D | 1.33 | 1.08 |
| Comparative Example 11 | 1.28 | 1.05 | C | D | D | D | C | D | 1.18 | 0.95 |
| Comparative Example 12 | 1.05 | 0.94 | D | D | C | D | D | D | 0.98 | 0.65 |
| Comparative Example 13 | 1.38 | 1.32 | B | B | B | C | B | B | 1.33 | 1.27 |

thereof and having inside a unit for generating a magnetic field, the latent image bearing member and the toner bearing member being placed with a predetermined interval therebetween, to develop an electrostatic latent image formed on the latent image bearing member with the magnetic toner, wherein the toner bearing member has an outer diameter of 6.0 mm or more and 10.0 mm or less, the magnetic toner includes magnetic toner particles containing at least a binder resin and a magnetic powder, an inorganic fine powder as a flowability-improving agent, and fine particles having a primary particle diameter in excess of 30 nm, the magnetic toner has an average circularity of 0.950 or more and a compressibility of 30 or less obtained from the following expression (1):

$$\text{Compressibility}=\{1-(\text{apparent density}/\text{tap density})\}\times 100 \quad (1); \text{ and}$$

a total energy of the toner measured with a powder flowability measuring apparatus satisfies the following expressions (2) and (3):

$$600 \leq TE_{10} \leq 1{,}500 \quad (2)$$

$$TE_{10}/TE_{100} \leq 1.60 \quad (3)$$

where $TE_{10}$ represents total energy (mJ) when a stirring rate is stirred is 10 mm/sec, and $TE_{100}$ represents total energy (mJ) when a stirring rate is stirred is 100 mm/sec.

2. An image-forming method according to claim 1, wherein a magnetic flux density of the unit for generating a magnetic field included in the toner bearing member toward the latent image bearing member is 600 G or more and 800 G or less at the surface of the toner bearing member.

3. An image-forming method according to claim 1, wherein the magnetic toner has a weight average particle diameter (D4) of 4.0 μm or more and 9.0 μm or less.

4. An image-forming method according to claim 1, wherein residual magnetization of the magnetic toner when the magnetic toner is polarized in a magnetic field of 79.6 kA/m is 3.0 $\mu m^2/kg$ or less.

5. An image-forming method according to claim 1, wherein an extraction $S_3$ (mass %) and an extraction $S_{15}$ (mass %) of a magnetic substance with respect to a total content of the magnetic substance at an extraction time of 3 minutes and an extraction time of 15 minutes, respectively, upon dispersing the magnetic toner in 5-mol/l hydrochloric acid satisfy the following expressions (4) and (5):

$$0.5 \leq S_3 \leq 10 \quad (4)$$

$$40 \leq S_{15} \leq 80 \quad (5).$$

6. An image-forming method according to claim 1, wherein the magnetic toner particles further includes a release agent, and in a wettability test of the magnetic toner with a mixed solvent of methanol and water, a methanol concentration when a transmittance of light having a wavelength of 780 nm is equal to 50% of the methanol transmittance, is 60 vol % or more and 80 vol % or less.

7. An image-forming method according to claim 1, wherein the fine particles have a number average diameter of 100 nm or more and 1.0 μm or less.

8. An image-forming method according to claim 1, wherein the flowability-improving agent has a BET specific surface area of 50 $m^2/g$ or more.

* * * * *